US010655884B2

(12) United States Patent
Iura et al.

(10) Patent No.: US 10,655,884 B2
(45) Date of Patent: May 19, 2020

(54) AIR CONDITIONER

(71) Applicant: DAIKIN INDUSTRIES, LTD., Osaka-shi, Osaka (JP)

(72) Inventors: Tsutomu Iura, Settsu (JP); Yasuyuki Aisaka, Settsu (JP); Taiki Sunahata, Settsu (JP); Masashi Saitou, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 113 days.

(21) Appl. No.: 15/570,183

(22) PCT Filed: Apr. 18, 2016

(86) PCT No.: PCT/JP2016/062252
§ 371 (c)(1),
(2) Date: Oct. 27, 2017

(87) PCT Pub. No.: WO2016/175073
PCT Pub. Date: Nov. 3, 2016

(65) Prior Publication Data

US 2018/0135878 A1 May 17, 2018

(30) Foreign Application Priority Data

Apr. 28, 2015 (JP) ..... 2015-091106

(51) Int. Cl.
*F24F 11/74* (2018.01)
*F24F 11/54* (2018.01)
(Continued)

(52) U.S. Cl.
CPC ..... *F24F 11/74* (2018.01); *F24F 3/065* (2013.01); *F24F 7/007* (2013.01); *F24F 11/30* (2018.01);
(Continued)

(58) Field of Classification Search
CPC .. F24F 11/74; F24F 11/49; F24F 7/007; F24F 11/65; F24F 11/54; F24F 11/30;
(Continued)

(56) References Cited

U.S. PATENT DOCUMENTS

2011/0111689 A1 5/2011 Takeuchi et al.
2014/0005838 A1 1/2014 Ogura
(Continued)

FOREIGN PATENT DOCUMENTS

CN 103429965 A 12/2013
CN 104374056 A 2/2015
(Continued)

OTHER PUBLICATIONS

International Search Report of corresponding PCT Application No. PCT/JP2016/062252 dated Jun. 7, 2016.
(Continued)

*Primary Examiner* — Steven S Anderson, II
(74) *Attorney, Agent, or Firm* — Global IP Counselors, LLP

(57) ABSTRACT

An air conditioner includes a plurality of indoor units of a refrigerant circuit to perform air conditioning of a space, and an air conditioning controller that controls operations of the plurality of indoor units by allocating the indoor units individually to a plurality of predetermined areas of the space. The controller performs an area registration process of allocating the indoor units individually to a plurality of area identification frames corresponding to the areas, and allocating a plurality of ventilators individually to the area identification frames where the indoor units are allocated. The ventilators perform ventilation of the space. The controller does not allow the operations of the plurality of the indoor units when there is an area identification frame to which none of the ventilators is allocated, in the plurality of
(Continued)

area identification frames where the indoor units are allocated.

7 Claims, 13 Drawing Sheets

(51) Int. Cl.

| | |
|---|---|
| ***F24F 11/63*** | (2018.01) |
| ***F24F 11/49*** | (2018.01) |
| ***F24F 7/007*** | (2006.01) |
| ***F24F 11/65*** | (2018.01) |
| ***F24F 3/06*** | (2006.01) |
| ***F24F 11/72*** | (2018.01) |
| ***F24F 11/30*** | (2018.01) |
| ***F24F 11/89*** | (2018.01) |
| *F24F 140/00* | (2018.01) |
| *F24F 110/65* | (2018.01) |

(52) U.S. Cl.
CPC ..... *F24F 11/49* (2018.01); *F24F 11/54* (2018.01); *F24F 11/63* (2018.01); *F24F 11/65* (2018.01); *F24F 11/72* (2018.01); *F24F 11/89* (2018.01); *F24F 2110/65* (2018.01); *F24F 2140/00* (2018.01)

(58) Field of Classification Search
CPC .. F24F 11/72; F24F 11/89; F24F 11/63; F24F 2110/65; F24F 2140/00; F24F 3/065
See application file for complete search history.

(56) References Cited

U.S. PATENT DOCUMENTS

| | | | | |
|---|---|---|---|---|
| 2015/0330646 | A1* | 11/2015 | Matsumoto | F24F 11/30 700/276 |
| 2015/0338120 | A1* | 11/2015 | Azuma | F25B 13/00 62/196.1 |
| 2016/0054017 | A1 | 2/2016 | Takahashi | |
| 2016/0245542 | A1* | 8/2016 | Maeda | F24F 11/30 |

FOREIGN PATENT DOCUMENTS

| | | | | |
|---|---|---|---|---|
| EP | 1 083 392 | A2 | 3/2001 | |
| JP | 2001-74283 | A | 3/2001 | |
| JP | 2009-300060 | A | 12/2009 | |
| JP | 2009300060 | A * | 12/2009 | |
| JP | 2011141081 | A * | 7/2011 | F24F 11/30 |
| WO | 2014156097 | A1 | 10/2014 | |

OTHER PUBLICATIONS

International Preliminary Report of corresponding PCT Application No. PCT/JP2018/062252 dated Nov. 9, 2017.
European Search Report of corresponding EP Application No. 16 78 6350.5 dated Mar. 26, 2018.

* cited by examiner

CORRESPONDENSE BETWEEN AREAS AND DEVICES AFTER OPERATIONS ARE ALLOWED

AIR CONDITIONER

CROSS-REFERENCE TO RELATED APPLICATIONS

This U.S. National stage application claims priority under 35 U.S.C. § 119(a) to Japanese Patent Application No. 2015-091106, filed in Japan on Apr. 28, 2015, the entire contents of which are hereby incorporated herein by reference.

TECHNICAL FIELD

The present invention relates to an air conditioner, and particularly to an air conditioner including: a plurality of indoor units configured to constitute a refrigerant circuit through which a refrigerant circulates and to perform air conditioning of a space to be air-conditioned, and an air conditioning controller configured to control operations of the plurality of indoor units by allocating, the plurality of indoor units individually to one of predetermined areas of the space to be air-conditioned.

BACKGROUND ART

In the past, as shown in JP-A-2001-74283, the following configuration is proposed: an indoor unit of an air conditioner having a refrigerant circuit through which a combustible refrigerant circulates and a ventilation fan (ventilator) are installed in a room space (space to be air-conditioned), and when leak of combustible refrigerant is detected, the ventilator is operated to discharge the combustible refrigerant from the space to be air-conditioned.

SUMMARY

In a case of cooling/heating and ventilating a space to be air-conditioned by an air conditioner and a ventilator installed in a construction such as a building, practically, the air conditioner and the ventilator are often installed independently of each other. In other words, there are various types of ventilators such as those having a fan like a ventilation fan, those having a total heat exchanger for waste heat recovery, and those having a dehumidifier and a humidifier for dehumidification and humidification, and one of these ventilators is selected independently of an air conditioner according to the needs of a user. Therefore, in many cases, the air conditioner and the ventilator are installed at an installation site independently of each other by different suppliers.

However, even when such an air conditioner and ventilator are selected and installed independently of each other, it is important to perform ventilation when refrigerant leaks, so that the limitations of an oxygen deficiency concentration, a combustible concentration, and a toxicity concentration are not exceeded in the space to be air-conditioned, and to prevent an occurrence of oxygen deficiency accidents, fire accidents (when the refrigerant mildly flammable or combustible) or intoxication accidents (when the refrigerant is toxic) in the space to be air-conditioned due to the leak of refrigerant from the air conditioner. However, if the air conditioner and ventilator are selected and installed independently, the installation is sometimes performed by different suppliers, and a communication system is not securely connected between these devices, which may result in a situation where the ventilator cannot be operated when refrigerant leaks from the air conditioner.

Furthermore, in a case of a multi-type room air conditioner having a plurality of indoor units, the indoor units are sometimes installed with ventilators in predetermined areas of the space to be air-conditioned respectively so that the indoor units and the ventilators operate in conjunction with each other. For example, when there is no worker m an office outside of work hours, the air conditioner and the ventilators are sometimes operated in conjunction with each other to stop their operations together for energy conservation.

However, even in the configuration in which the multi-type room air conditioner and the ventilators are operated in conjunction with each other, the air conditioner and the ventilators themselves are devices that can be installed and operated independently. In other words, when a communication system is connected between the two types of devices, the both devices can be operated in conjunction with each other when necessary. However, when a communication system is not connected between them, the devices are not operated in conjunction with each other, and simply operated independently. In consideration of the configuration where a multi-type room air conditioner and ventilators are selected and installed independently as described above, the following situation may occur a communication system is not securely connected between the air conditioner and ventilators at an installation site, even when a configuration is to be used, as shown in JP-A-2001-74283, in which refrigerant is to be discharged from a space to be air-conditioned by operating a ventilator when refrigerant leak from an air conditioner is detected. Therefore, the following problem is involved in the configuration where a multi-type room air conditioner and ventilators are installed independently of each other, the air conditioner is likely to be operated without any countermeasures such as operating the ventilators when refrigerant leaks, and it is impossible to suppress an accident caused by the refrigerant leak from the air conditioner.

An object of the present invention is to provide an air conditioner including: a plurality of indoor units configured to constitute a refrigerant circuit through which a refrigerant circulates and to perform air conditioning of a space to be air-conditioned, and an air conditioning controller configured to control operations of the plurality of indoor units by allocating the plurality of indoor units individually to one of predetermined areas of the space to be air-conditioned, so as to surely suppress an accident caused by refrigerant leak from the air conditioner.

An air conditioner according to a first aspect is an air conditioner, including: a plurality of indoor units configured to constitute a refrigerant circuit through which a refrigerant circulates and to perform air conditioning of a space to be air-conditioned; and an air conditioning controller configured to control operations of the plurality of indoor units by allocating the plurality of indoor units individually to one of predetermined areas of the space to be air-conditioned. The air conditioning controller is configured to perform an area registration process of allocating the indoor units individually to one of area identification frames that each correspond to the areas, and allocating ventilators individually to one of the area identification frames where the indoor units are allocated, the ventilators being configured to perform ventilation of the space to be air-conditioned. The air conditioning controller is further configured not to allow the operations of the plurality of the indoor units when there is an area identification frame to which none of the ventilators is allocated, in the area identification frames where the indoor units are allocated.

In this aspect, as described above, in the area registration process in which the plurality of indoor units configured to constitute a multi-type room air conditioner are allocated individually to one of predetermined areas of a space to be air-conditioned, the process of allocating the indoor units individually to one of the area identification frames that each correspond to the areas is performed, and also the process of allocating the ventilators individually to one of the area identification frames where the indoor units are allocated is performed. Therefore, in this aspect, it is possible to establish a state without an area identification frame to which none of the ventilators is allocated, and a communication system between the air conditioner and the ventilators is securely connected at the installation site.

Therefore, even in a configuration in which a multi-type room air conditioner and ventilators are installed independently of each other, the air conditioner can be operated in a state that a countermeasure is established such as operating the ventilators when refrigerant leaks, so that an accident caused by refrigerant leak from the air conditioner can be surely suppressed.

An air conditioner according to a second aspect is an air conditioner according to the first aspect, and the air conditioning controller has an area preparation mode for performing the area registration process. The air conditioning controller does not allow the area preparation mode to end, when there is an area identification frame to which none of the ventilators is allocated, in the plurality of area identification frames where the indoor units are allocated.

In this aspect, as described above, in the area preparation mode, when there is an area identification frame to which none of the ventilators is allocated in the plurality of area identification frames where the indoor units are allocated, the area preparation mode is not allowed to end. Therefore, in this aspect, the area registration process is surely performed before air conditioning operation starts, so as to obtain a state where a countermeasure such as operating the ventilators when refrigerant leaks can be surely established.

An air conditioner according to a second aspect is an air conditioner according to the first or the second aspect, and the air conditioning controller includes: indoor controllers configured to control components of each of the indoor units; and a centralized controller configured to give a control command to the plurality of indoor controllers for each of the area identification frames so as to control. The centralized controller is configured to perform the area registration process.

In this aspect, as described above, the centralized controller in the air conditioning controller is configured to perform the area registration process. Therefore, in this aspect, a control command is given for each of the area identification frames. That is, via the centralized controller configured to perform area controlling, the connection of a communication system can be securely established between the air conditioner and the ventilators at their installation site.

DESCRIPTION OF EMBODIMENTS

Embodiments of an air conditioner according to the present invention will be described hereafter, based on the drawings. The specific configurations of the embodiments of the air conditioner according to the present invention are not limited to the following embodiments and modified examples thereof, and can be modified in a range not departing from the gist of the invention.

(1) Configuration

<Overall>

Figure 1:
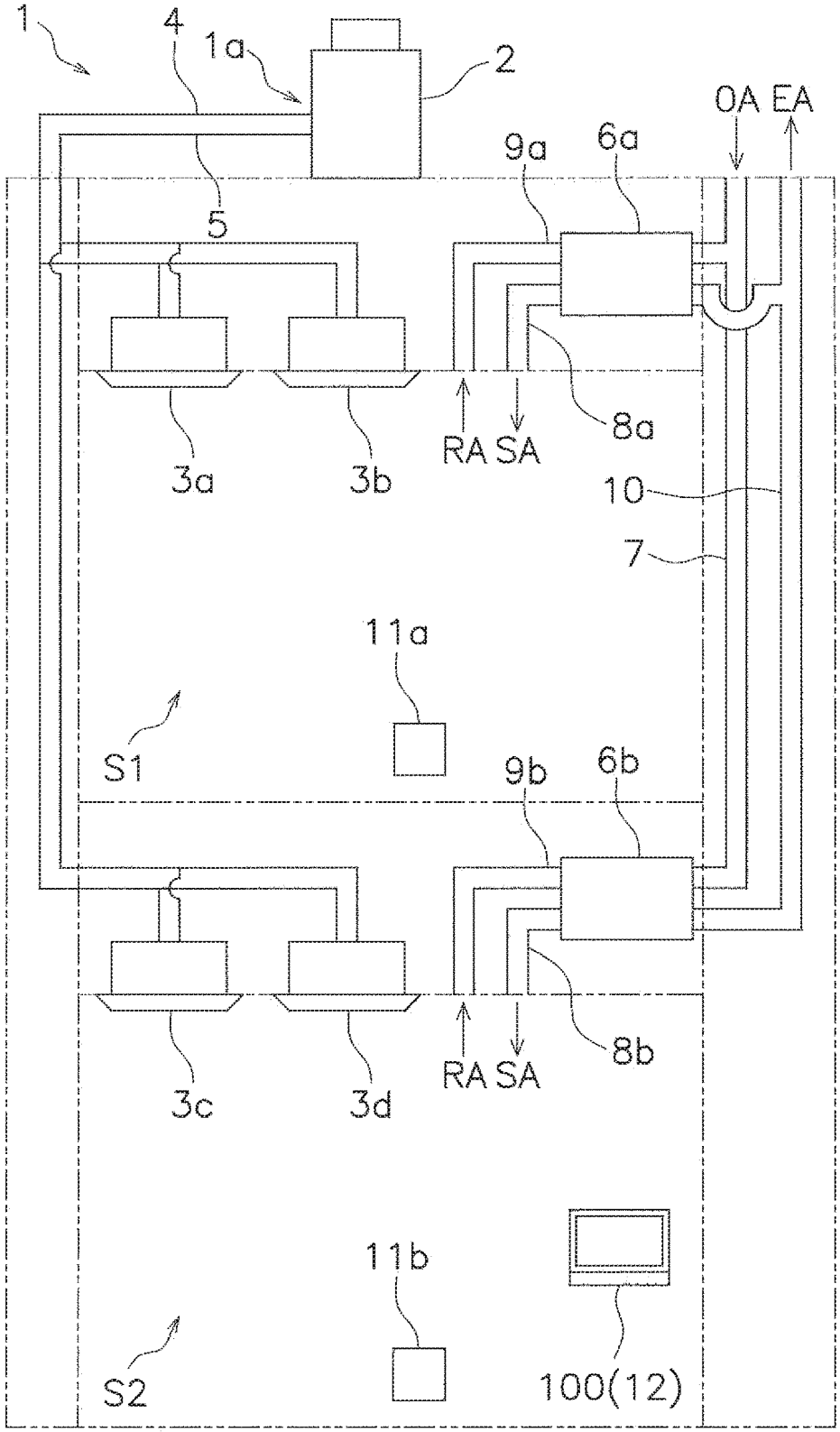
FIG. 1 is an overall configuration diagram of an air-conditioning ventilation system including an air conditioner according to an embodiment of the present invention.
Figure 2:
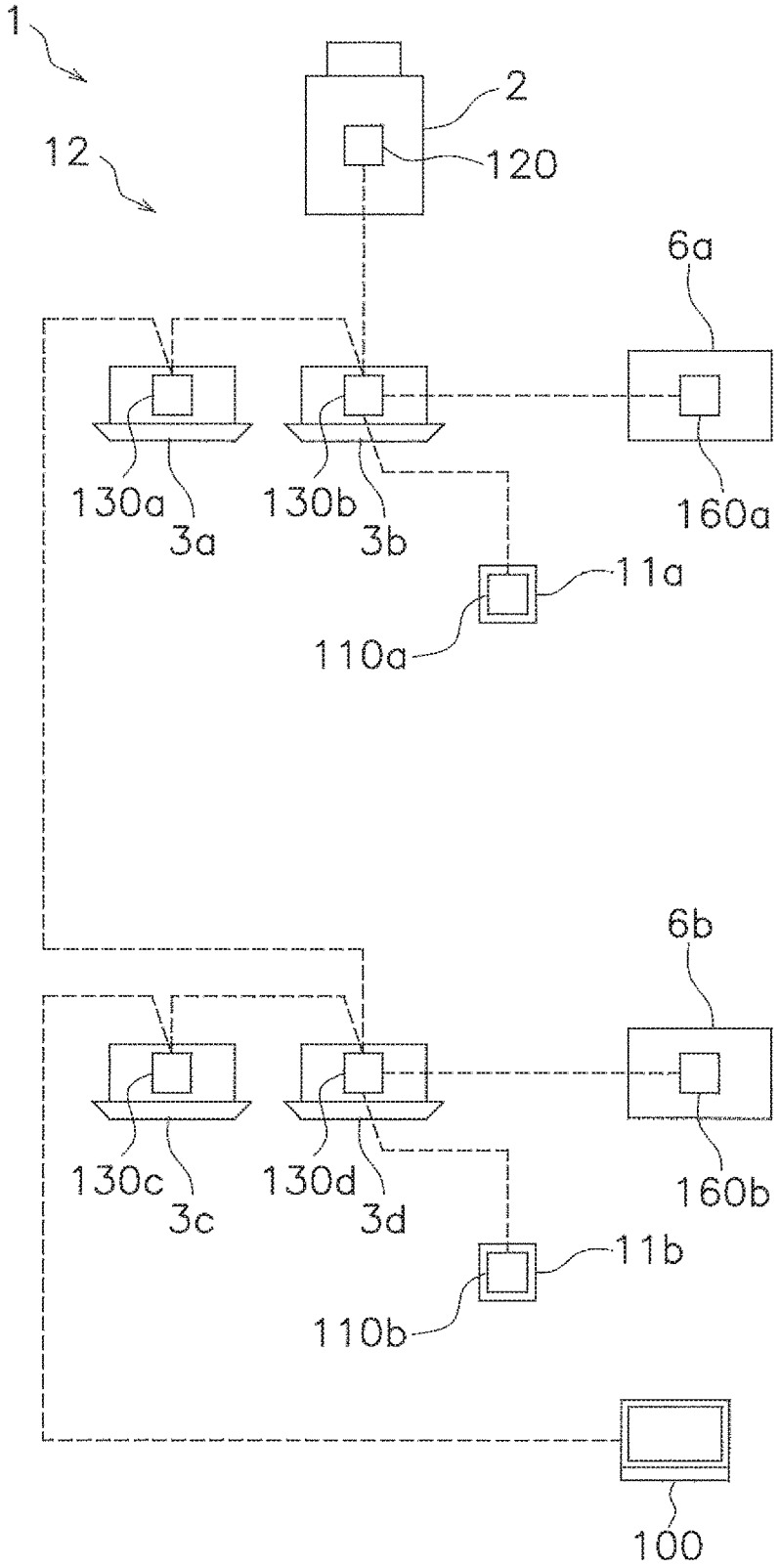
FIG. 2 is a diagram of a communication system of the air-conditioning ventilation system.

FIG. 1 is an overall configuration diagram of an air-conditioning ventilation system having an air conditioner 1 according to an embodiment of the present invention. FIG. 2 is a diagram of a communication system of the air-conditioning ventilation system.

The air-conditioning ventilation system mainly includes an air conditioner 1 capable of performing cooling and heating of a space to be air-conditioned, and ventilators 6*a* and 6*b* configured to perform ventilation of the space to be air-conditioned. The air-conditioning ventilation system also includes refrigerant leak detectors 11*a* and 11*b* that detect refrigerant.

The air conditioner 1 is a multi-type room air conditioner including: a refrigerant circuit 1*a* through which the refrigerant circulates, the refrigerant circuit 1*a* being configured by connecting a plurality of (four in this embodiment) indoor units 3*a*, 3*b*, 3*c*, and 3*d* to an outdoor unit 2; and an air conditioning controller 12 as a controller that controls operation of the indoor units 3*a*, 3*b*, 3*c*, 3*d* and the outdoor unit 2. Here, the indoor units 3*a* and 3*b* are installed, on the ceiling of an area S1 for example, in order to perform cooling and heating of the area S1 which is one of the predetermined areas of the space to be air-conditioned, and the indoor units 3*c* and 3*d* are installed on the ceiling of an area S2 for example, in order to perform cooling and heating of the area S2 which is the other one of the predetermined areas of the space to be air-conditioned. The outdoor unit 2 is installed on a roof floor of the construction, for example. The refrigerant circuit 1*a* is configured from the plurality of indoor units 3*a*, 3*b*, 3*c*, 3*d* and the outdoor unit 2 that are connected to each other using refrigerant communication pipes 4 and 5. The refrigerant circuit 1*a* encloses therein a refrigerant having lower flammability such as R32, or a refrigerant having combustibility such as propane, or a refrigerant having toxicity such as ammonia, as the refrigerant. The air conditioning controller 12 controls the operation of the plurality of indoor units 3*a*, 3*b*, 3*c*, 3*d*, etc., by allocating the plurality of indoor units 3*a*, 3*b*, 3*c*, and 3*d* individually to one of the predetermined areas S1 and S2 of the space to be air-conditioned. The air conditioning controller 12 is configured from a plurality of indoor controllers 130*a*, 130*b*, 130*c*, and 130*d*, an outdoor controller 120, and a centralized controller 100 that are connected to each other via a communication line. The indoor controllers 130*a*, 130*b*, 130*c*, and 130*d* are provided corresponding to each of indoor units 3*a*, 3*b*, 3*c*, and 3*d*, and when a remote controller is provided corresponding to each of the indoor units 3*a*, 3*b*, 3*c*, and 3*d*, the remote controllers are also included in the indoor controllers 130*a*, 130*b*, 130*c*, and 130*d* respectively. The outdoor controller 120 is provided to the outdoor unit 2. The centralized controller 100 is provided, for example, in a construction (in this embodiment, the area S2) that forms the space to be air-conditioned.

The plurality of ventilators 6*a* and 6*b* (two in this embodiment) are provided corresponding to each of the areas S1 and S2. In this embodiment, the ventilator 6*a* is installed on the ceiling-back, etc., of the area S1 in order to perform ventilation of the area S1, and the ventilator 6*b* is installed on the space above the ceiling, etc., of the area S2 in order to perform ventilation of the area S2. The ventilators ha and 6*b* include ventilation controllers 160*a* and 160*b* respectively, and when a remote controller is provided corresponding to each of the ventilatiors 6*a* and 6*b*, the remote controllers are also included in the ventilation controllers 160*a* and 160*b* respectively. The ventilation controllers 160*a* and 160*b* are connected to the indoor controllers 130*a*, 130*b*, 130*c*, and 130*d* of the air conditioning controller 12 via the communication line, in order to establish operating in conjunction with the air conditioner 1.

A plurality of refrigerant leak detectors 11*a* and 11*b* (two in this embodiment) are provided corresponding to each of the areas S1 and S2. In this embodiment, the refrigerant leak detector 11*a* is provided in the area S1 in order to detect whether any refrigerant leaks from the indoor units 3*a* and 3*b* in the area S1, and the refrigerant leak detector 11*b* is provided in the area S2 in order to detect whether any refrigerant leaks from the indoor units 3*c* and 3*d* in the area S2. The refrigerant leak detectors 11*a* and 11*b* include detection controllers 110*a*, and 11% respectively, and are connected to the indoor controllers 130*a*, 130*b*, 130*c*, and 130*d* of the air conditioning controller 12 via the communication line, m order to inform the air conditioner 1 whether any refrigerant leaks in the areas S1 and/or S2 or not.

<Air Conditioner>

Figure 3:
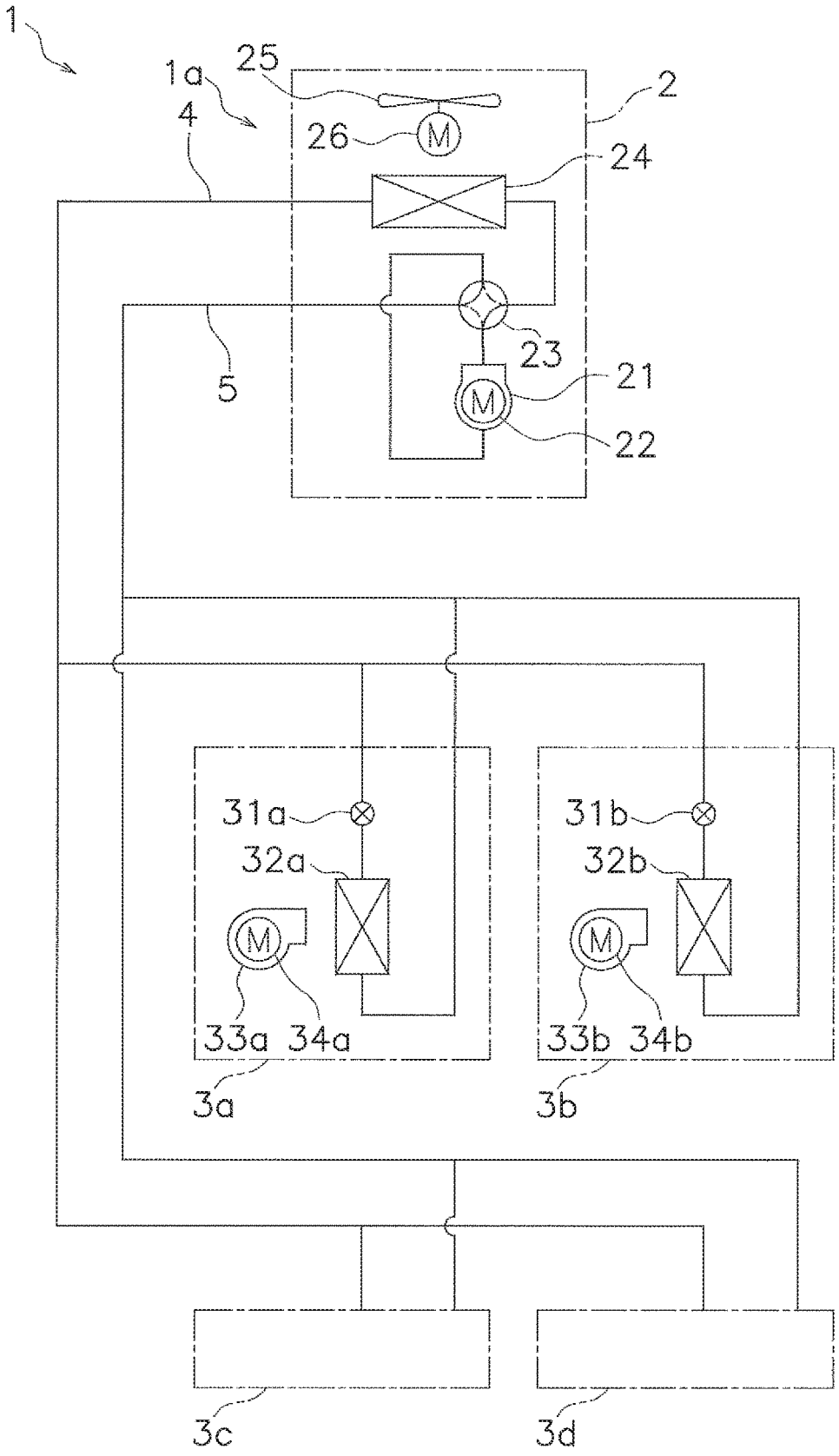
FIG. 3 is a diagram of components and piping system of the air conditioner.

FIG. 3 is a diagram of components and piping system of the air conditioner 1. Here, in FIG. 3, the components and piping configuration connecting the outdoor unit 2 and the indoor units 3*a* and 3*b* is shown in detail, and components and piping configuration connecting the indoor units 3*c* and 3*d* is not shown, —Outdoor Unit—

The outdoor unit 2 is connected to the indoor units 3*a*, 3*b*, 3*c* and 3*d* via the refrigerant communication pipes 4 and 5 as described above, and constitutes apart of the refrigerant circuit 1*a*.

The outdoor unit 2 mainly includes a compressor 21, a switching mechanism 23, and an outdoor heat exchanger 24.

The compressor 21 is a mechanism for compressing refrigerant, and in this embodiment, a sealed compressor is employed, in which a positive displacement compression element (not shown) such as a rotor and a scroll housed in a casing (not shown) is driven by a compressor motor 22 which is also housed in the casing.

The switching mechanism 23 is a four-way switching valve capable of switching between a cooling operation state in which the outdoor heat exchanger 24 functions as a refrigerant radiator and a heating operation state in which the outdoor heat exchanger 24 functions as a refrigerant evaporator. Here, the cooling operation state is a switching state in which a discharge side of the compressor 21 and a gas side of the outdoor heat exchanger 23 are communicated with each other and a gas refrigerant communication pipe 3 and a suction side of the compressor 21 are communicated with each other (see the solid line of the switching mechanism 23 in FIG. 3). The heating operation state is a switching state in which the discharge side of the compressor 21 and the gas refrigerant communication pipe 5 are communicated with each other, and the gas side of the outdoor heat exchanger 23 and the suction side of the compressor 21 are communicated with each other (see the broken line of the switching mechanism 23 in FIG. 3). Note that the switching mechanism 23 is not limited to the four-way switching valve, and for example, may be configured to have a function of switching a flow direction of the refrigerant as described above by combining a plurality of solenoid valves or the like.

The outdoor heat exchanger 24 is a heat exchanger that functions as a refrigerant radiator or an evaporator by performing heat exchange between the refrigerant and the outdoor air (OA). The outdoor air (OA) used for the heat exchange with the refrigerant by the outdoor heat exchanger 24, is supplied to the outdoor heat exchanger 24 by an outdoor fan 25 that is driven by an outdoor fan motor 26.

—Indoor Unit—

As described above, the indoor units 3*a*, 3*b*, 3*c*, and 3*d* are connected to the outdoor unit 2 via the refrigerant communication pipes 4 and 5, and constitute a part of the refrigerant circuit 1*a*. In the following, the configuration of the indoor unit 3*a* will be described, and the subscript "a" can be rewritten to "b", "c", and "d" for the detail description of the configurations of the indoor units 3*b*, 3*c*, and 3*d* respectively, and the detail description is omitted here.

The indoor unit 3*a* mainly includes an indoor expansion mechanism 31*a* and an indoor heat exchanger 32*a*.

The indoor expansion mechanism 31*a* is an electric expansion valve capable of changing a flow rate of the refrigerant flowing through the indoor heat exchanger 32*a* by controlling the opening degree.

The indoor heat exchanger 32*a* is a heat exchanger that functions as a refrigerant evaporator or a radiator through heat exchange between the refrigerant and the room air (RA). The room air (RA) used for the heat exchange with the refrigerant by the indoor heat exchanger 32*a* is supplied to the indoor heat exchanger 32*a* by an indoor fan 33*a* that is driven by an indoor fan motor 34*a*.

<Ventilator>

Figure 4:
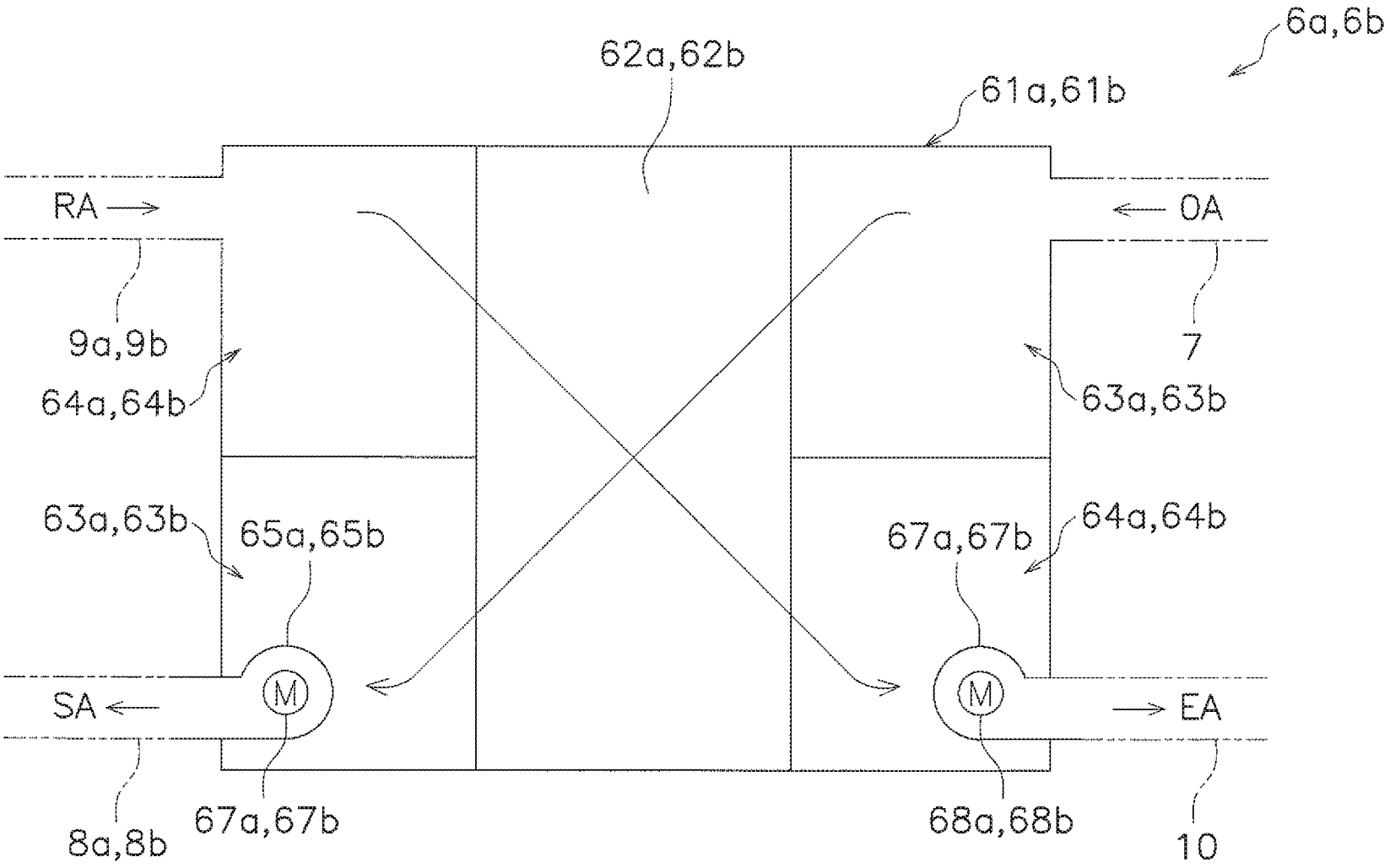
FIG. 4 is a configuration diagram of components of ventilators.

FIG. 4 is a configuration diagram of components of the ventilators 6*a* and 6*b*.

In this embodiment, ventilators having heat exchangers 62*a* and 62*b* are employed as the ventilators 6*a* and 6*b* respectively. In the following, the configuration of the ventilator 6*a* will be described, and the subscript "a" can be rewritten to "b" for the description of the configuration of the ventilator 6*b*, and the detail description is omitted here.

The ventilator 6*a* mainly includes a device main body 61*a* that is connected to: an inlet duct 7 connected to an inlet port for drawing the outdoor air (OA) into a space to be air-conditioned (in this embodiment, the area S1); an air supply duct 8*a* connected to an air supply port for supplying the outdoor air (OA) as supply air (SA); an outlet duct 9*a* connected to outlet ports for drawing the room air (RA) out of the area S1, and an exhaust duct 10 connected to an exhaust port for discharging the room air (RA) to outside as exhaust air (EA).

The device main body 61*a* includes the heat exchanger 62*a* and two ventilation paths 63*a* and 64*a* which are mutually partitioned and formed so as to cross the heat exchanger 62*a*. In this embodiment, the heat exchanger 62*a* is a total heat exchanger that simultaneously exchanges sensible heat and latent heat between two air flows (in this embodiment, the room air and outdoor air), and is disposed so as to transverse the ventilation paths 63*a* and 64*a*. The ventilation path 63*a* is connected to the inlet duct 7 at one end thereof and to the air supply duct 8*a* at the other end thereof, and constitutes an air supply path for flowing air from the outside toward the area S1. The other ventilation path 64*a* is connected to the outlet duct 9*a* at one end thereof and to the exhaust duct 10 at the other end thereof, and constitutes an exhaust path for flowing air flow from the area S1 toward the outside. The air supply path 63*a* also has an air supply fan 65*a* that is driven by a supply fan motor 66*a* to generate an air flow directed from the outside to the area S1, and the exhaust path 64*a* has an air exhaust fan 67*a* that is driven by an exhaust fan motor 68*a* to generate an air flow directed from the area S1 toward the outside. The air supply fan 65*a* and the air exhaust fan 67*a* are arranged downstream of the heat exchanger 62*a* with respect to the air flow.

<Controller>

Figure 5:
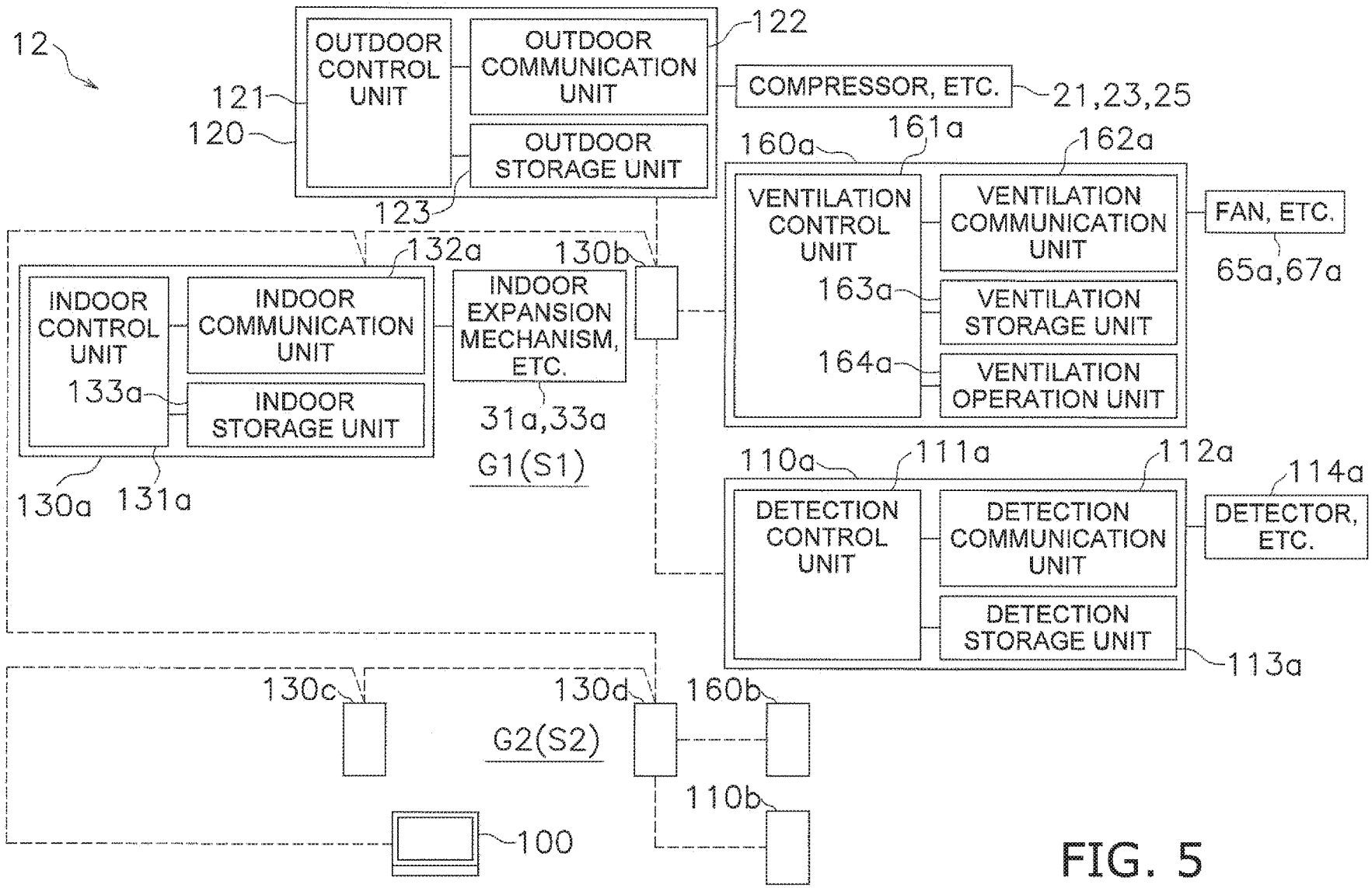
FIG. 5 is a control block diagram of an air-conditioning ventilation system (details other than the centralized controller are shown).
Figure 6:
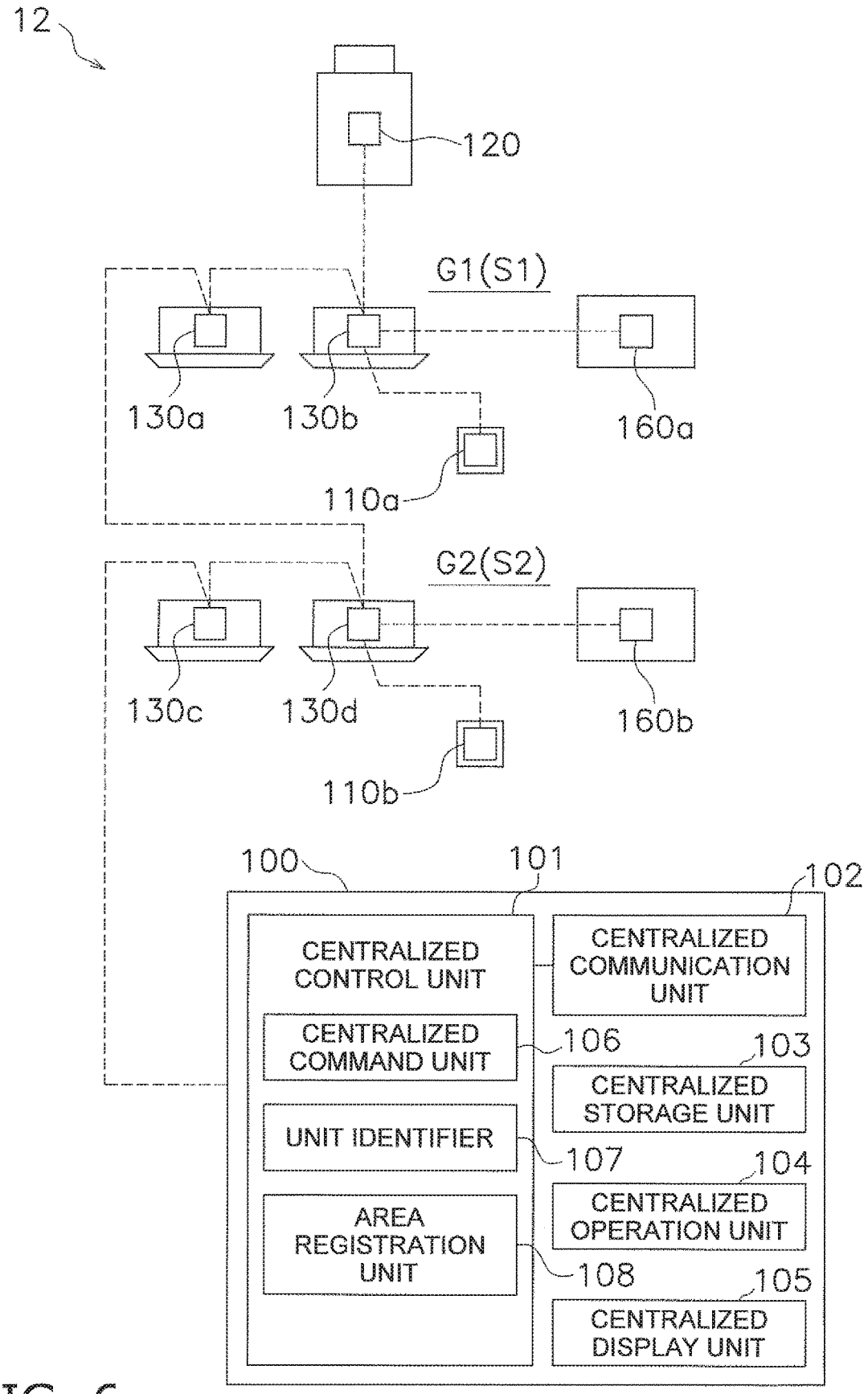
FIG. 6 is a control block diagram of the air-conditioning ventilation system (details of the centralized controller are shown).

FIG. 5 is a control block diagram of an air-conditioning ventilation system (details other than a centralized controller 100 are shown), and FIG. 6 is a control block diagram of the air-conditioning ventilation system (details of the centralized controller 100 are shown). Note that, in FIG. 5, the indoor controllers 130*b*, 130*c*, and 130*d*, the ventilation controller 160*b*, and the detection controller 110*b* are not shown.

<Outdoor Controller>

An outdoor controller 120 controls the components of the outdoor unit 2, and constitutes a part of the air conditioning controller 12. The outdoor controller 120 mainly includes an outdoor control unit 121, an outdoor communication unit 122, and an outdoor storage unit 123.

The outdoor control unit 121 is connected to the outdoor communication unit 122 and the outdoor storage unit 123. The outdoor communication unit 122 communicates control data and the like with the indoor controllers 130*a*, 130*b*, 130*c*, and 130*d* and the centralized controller 100. The outdoor storage unit 123 stores the control data and the like. Then, the outdoor control unit 121 controls the operation of the devices 21, 23, and 25 such as compressor installed in the outdoor unit 2, while communicating and reading/writing the control data and the like via the outdoor communication unit 122 and/or the outdoor storage unit 123.

—Indoor Controller—

The indoor controllers 130*a*, 130*b*, 130*c*, and 130*d* control the components of the corresponding indoor units 3*a*, 3*b*, 3*c*, and 3*d*, respectively, and constitute a part of the air conditioning controller 12. The indoor controllers 130*a*, 130*b*, 130*c*, and 130*d* mainly include indoor control units 131*a*, 131*b*, 131*c*, and 131*d*, indoor communication units 132*a*, 132*b*, 132*c*, and 132*d*, and indoor storage units 133*a*, 133*b*, 133*c*, and 133*d*, respectively. In the following, the configuration of the indoor controller 130*a* will be described, and the subscript "a" can be rewritten to "b", "c", "d" for the description of the configurations of the indoor controllers 130*b*, 130*c*, and 130*d*, and the detail description is omitted here.

The indoor control unit 131*a* is connected to the indoor communication unit 132*a* and the indoor storage unit 133*a* The indoor communication unit 132*a* communicates control data and the like with the outdoor controller 120, the other indoor controllers 130*b*, 130*c*, and 130*d*, the ventilation controller 160*a*, the detection controller 110*a*, and the centralized controller 100. The indoor storage unit 133*a* stores the control data and the like. The indoor control unit 131*a* controls the operation of the devices 31*a* and 33*a* such as the indoor expansion mechanism provided to the indoor unit 3*a*, while communicating and reading/writing the control data and the like via the indoor communication unit 132*a* and the indoor storage unit 133*a*.

—Ventilation Controller—

The ventilation controllers 160*a* and 160*b* control the components of the corresponding ventilators 6*a* and 6*b*, respectively. The ventilation controllers 160*a* and 160*b* mainly include: ventilation control units 161*a* and 161*b*, ventilation communication units 162*a* and 162*b*, ventilation storage units 163*a* and 163*b*, and ventilation operation units 164*a* and 164*b*, respectively. In the following, the configuration of the ventilation controller 160*a* will be described, and the subscript "a" can be rewritten to "b" for the description of the configuration of the ventilation controller 160*b*, and the detail description is omitted here.

The ventilation control unit 161*a* is connected to the ventilation communication unit 162*a*, the ventilation storage unit 163*a*, and the ventilation operation unit 164*a*. The ventilation communication unit 162*a* communicates control data and the like with the indoor controllers 130*a* and 130*b* and the centralized controller 100. The ventilation storage unit 163*a* stores the control data and the like. The ventilation operation unit 164*a* inputs control commands and the like. Then, the ventilation control unit 161*a* controls the operation of the devices 65*a* and 67*a* such as fans of the ventilator 6*a*, while communicating and reading/writing the control data and the like via the ventilation communication unit 162*a*, the ventilation storage unit 163*a*, and the ventilation operation unit 164*a*.

—Detection Controller—

Detection controllers 110*a* and 110*b* control the components of the corresponding refrigerant leak detectors 11*a* and 11*b*, that is, perform an operation of detecting refrigerant using refrigerant detectors 114*a* and 114*b*, respectively. The detection controllers 110*a* and 110*b* mainly include: detection control units 111*a* and 111*b*, detection communication units 112*a* and 112*b*, and detection storage units 113*a* and 113*b*, respectively. In the following, the configuration of the detection controller 110*a* will be described, and the subscript "a" can be rewritten to "b" for the description of the configurations of the detection controller 110*b*, and the detail description is omitted here.

The detection control unit 111*a* is connected to the detection communication unit 112*a* and the detection storage unit 113*a*. The detection communication unit 112*a* communicates control data and the like with the indoor controllers 130*a* and 130*b* and the centralized controller 100. The detection storage unit 113*a* stores the control data and the like. The detection control unit 111*a* performs an operation of detecting refrigerant using the refrigerant detector 114*a* of the refrigerant leak detectors 11*a*, while communicating and reading/writing the control data and the like via the detection communication unit 112*a* and the detection storage unit 113*a*.

—Centralized Controller—

In response to an input of an operation command or the like, the centralized controller 100 gives a control command to the indoor controllers 130*a*, 130*b*, 130*c*, and 130*d* of the plurality of indoor units 3*a*, 3*b*, 3*c*, and 3*d*, and also perform displaying of operations, and constitutes a part of the air conditioning controller 12. The centralized controller 100 mainly includes: a centralized control unit 101, a centralized communication unit 102, a centralized storage unit 103, a centralized operation unit 104, and a centralized display unit 105.

The centralized control unit 101 is connected to the centralized communication unit 102, the centralized storage unit 103, the centralized operation unit, 104 and the centralized display unit 105. The centralized communication unit 102 communicates control data and the like, with the indoor controllers 130*a*, 130*b*, 130*c*, and 130*d*, the ventilation controllers 160*a* and 160*b*, and the detection controllers 110*a* and 110*b*. The centralized storage unit 103 stores the control data and the like. The centralized operation unit 104 inputs control commands and the like. The centralized display unit 105 performs displaying of operations and the like. Then, in response to an input of an operation command or the like via the centralized operation unit 104, the centralized control unit 101 reads and writes the control data and the like from and into the centralized storage unit 103, and gives a control command to the outdoor controller 120, the indoor controllers 130*a*, 130*b*, 130*c*, and 130*d*, the ventilation controllers 160*a* and 160*b*, and the detection controllers 110*a* and 110*b*, via the centralized communication unit 102, while performing display operation on the centralized display unit 105. The centralized control unit 101 includes a centralized command unit 106, as a means for giving the control command or the like, to the outdoor controller 120, the indoor controllers 130*a*, 130*b*, 130*c*, and 130*d*, the ventilation controllers 160*a* and 160*b*, and the detection controllers 110*a* and 110*b*.

The centralized control unit 101 also includes a unit identifier 107 and an area registration unit 108.

The unit identifier 107 is a control unit that performs a unit identification process of assigning unit numbers respectively to the indoor units 3*a*, 3*b*, 3*c*, and 3*d*, the ventilators 6*a*, and 6*b*, and the refrigerant leak detectors 11*a* and 11*b* to distinguish them from each other. Specifically, the unit identifier 107 communicates with the indoor controllers 130*a*, 130*b*, 130*c*, and 130*d*, the ventilation controllers 160*a* and 160*b*, and the detection controllers 110*a* and 110 via the centralized communication unit 102, after the air conditioner 1, the ventilatiors 6*a*, and 6*b*, and the refrigerant leak detectors 11*a* and 11*b* are installed at a site and before a trial run on them is performed. Then, the unit identifier 107 identifies the type of a device (in this embodiment, any of the indoor unit, the ventilator, and the refrigerant leak detector of the air conditioner) to be controlled by each of the controllers, and thereafter assign unit numbers to the indoor controllers 130*a*, 130*b*, 130*c* and 130*d*, the ventilation controllers 160*a* and 160*b*, and the detection controllers 110*a* and 110*b* respectively. Here in the process, the unit numbers may be automatically assigned by the unit identifier 107, or may be assigned by the unit identifier 107 by input via the centralized operation unit 104. Alternatively, when a remote controller is provided correspondingly to each of the indoor units 3*a*, 3*b*, 3*c*, and 3*d*, the unit numbers may be assigned manually through the remote controllers. The unit number assigned by the unit identifier 107 or the like is stored in the centralized storage unit 103 together with a model code indicating the type of each device. The unit number assigned to each device by the unit identifier 107 or the like is also stored in the indoor storage units 133*a*, 133*b*, 133*c*, and 133*d*, the ventilation storage units 163*a* and 163*b*, and the detection storage units 113*a* and 113*b*.

The area registration unit 108 is a control unit that performs an area registration process to allocate the indoor units 3*a*, 3*b*, 3*c*, and 3*d* individually to one of area identification frames (in this embodiment, G1 and G2) each corresponding to predetermined areas (in this embodiment, the areas S1 and S2 of the space to be air-conditioned), and allocate the ventilators 6*a* and 6*b* that performs ventilation of the space to be air-conditioned, individually to one of the area identification frames G1 and G2 where the indoor units 3*a*, 3*b*, 3*c*, and 3*d* are allocated. Furthermore, in this embodiment, in the area registration process, the area registration unit 108 also performs a process of allocating the refrigerant leak detectors 11*a* and 11*b* that detect whether the refrigerant leaks or not, individually to one of the area identification frames G1 and G2 where the indoor units 3*a*, 3*b*, 3*c*, and 3*d* are allocated. Specifically, the area registration unit 108 first creates area identification frames (G1, G2 in this embodiment) each corresponding to the predetermined areas (in this embodiment, areas S1 and S2) of the space to be air-conditioned. Here, the process of creating the area identification frames is performed by the area registration unit 108 by input via the centralized operation unit 104. Next, the area registering unit 108 performs the process of allocating the indoor units 3*a*, 3*b*, 3*c*, and 3*d*, the ventilators 6*a* and 6*b*, and the refrigerant leak detectors 11*a* and 11*b* each having the assigned unit number, individually to one of the created area identification frames. Here, the process of allocating the devices individually to one of the area identification frames is performed through the area registration unit 108 by input via the centralized operation unit 104, and the correspondences between the devices and the area identification frames obtained by the area registration unit 108 are stored m the centralized storage unit 103 as the data associated with the unit numbers and the model codes. Furthermore, the area registration unit 108 communicates with the indoor controllers 130*a*, 130*b*, 130*c*, and 130*d*, the ventilation controllers 160*a* and 160*b*, and the detection controllers 110*a* and 110*b* via the centralized communication unit 102, and assigns the allocated area identification frames individually to one of the indoor controllers 130*a*, 130*b*, 130*c*, and 130*d*, the ventilation controllers 160*a* and 160*b*, and the detection controllers 110*a* and 110*b*. Then, the area identification frames assigned by the area registration unit 108 are stored in the indoor storage units 133*a*, 133*b*, 133*c*, and 133*d*, the ventilation storage units 163*a* and 163*b*, and the detection storage units 113*a* and 113*b* as data associated with the unit numbers. The unit numbers and the model codes of the ventilators 6*a* and 6*b* and the refrigerant leak detectors 11*a* and 11*b* allocated to the same area identification frames are also stored in the indoor storage units 133*a*, 133*b*, 133*c* and 133*d*. Note that the area registration process is performed in the area preparation mode that starts after the unit identification process is completed. However, when there is an area identification frame to which none of the ventilators 6*a* and 6*b* is allocated, in a plurality of area identification frames (G1 and G2 in this embodiment) where the indoor units 3*a*, 3*b*, 3*c*, and 3*d* are allocated, the area preparation mode is not allowed to end.

(2) Operation

In the air-conditioning ventilation system including the air conditioner 1, the ventilators 6*a* and 6*b*, and the refrigerant leak detectors 11*a* and 11*b*, the following operations are performed.

—Air Conditioning Operation—

A cooling operation is described first. When the air conditioning controller 12 (centralized controller 100) gives a command to the air conditioner 1 to perform cooling operation, the switching mechanism 23 is switched to the cooling operation state (the state shown by the solid line of the switching mechanism 23 in FIG. 3), and the compressor 21 and the outdoor fan 25 are activated. When the area S1 is specified as the space to be air-conditioned for the cooling operation, the indoor fans 33*a* and 33*b* are activated, and when the area S2 is specified as the space to be air-conditioned for cooling operation, the indoor fans 33*c* and 33*d* are activated, and when both of the areas S1 and S2 are specified as the space to be air-conditioned for cooling operation, the indoor fans 33*a*, 33*b*, 33*c* and 33*d* are activated.

Subsequently, the high-pressure gas refrigerant in the refrigerant circuit 1*a* is sent to the outdoor heat exchanger 24 via the switching mechanism 23. In the outdoor heat exchanger 24 that functions as a refrigerant radiator, heat exchange is carried out between the high-pressure gas refrigerant which is sent to the outdoor heat exchanger 24, and the outdoor air (OA) supplied by the outdoor fan 25, and the high-pressure gas refrigerant is cooled and condensed, to become a high-pressure liquid refrigerant. The high-pressure liquid refrigerant is sent from the outdoor unit 2 to the indoor units 3*a* and 3*b* and/or the indoor units 3*c* and 3*d*, via the liquid refrigerant communication pipe 4, to cool the area S1 and/or the area S2.

The high-pressure liquid refrigerant sent to the indoor units 3*a*, 3*b* and/or the indoor units 3*c*, 3*d*, is decompressed by the indoor expansion mechanisms 31*a* and 31*b* and/or the indoor expansion mechanisms 31*c* and 31*d*, and becomes a low-pressure gas-liquid two-phase refrigerant. The low-pressure gas-liquid two-phase refrigerant is sent to the indoor heat exchangers 32*a* and 32*b* and/or the indoor heat exchangers 32*c* and 32*d*. Heat exchange is then carried out between the low-pressure gas-liquid two-phase refrigerant sent to the indoor heat exchangers 32*a* and 32*b* and/or the indoor heat exchangers 32*c* and 32*d*, and the room air (RA) supplied from the area S1 and/or the area S2 by the indoor fans 33*a* and 33*b* and/or the indoor fans 33*c* and 33*d*, in the indoor heat exchangers 32*a* and 32*b* and/or the indoor heat exchangers 32*c* and 32*d* that function as refrigerant evaporators, so that the low-pressure gas-liquid two-phase refrigerant is heated, evaporated, and becomes a low-pressure gas refrigerant. The low-pressure gas refrigerant is sent from the indoor units 3*a* and 3*b* and/or the indoor units 3*c* and 3*d* to the outdoor unit 2 through the gas refrigerant communication pipe 5. Meanwhile, the room air (RA) cooled in the indoor heat exchangers 32*a* and 32*b* and/or the indoor heat exchangers 32*c* and 32*d*, is sent to the area S1 and/or the area S2, whereby the cooling of the area S1 and/or the area S2 is performed.

The low-pressure gas refrigerant sent to the outdoor unit 2 is again sucked into the compressor 21 through the switching mechanism 23.

A heating operation is described next. When the air conditioning controller 12 (the centralized controller 100) gives a heating operation command to the air conditioner 1, the switching mechanism 23 is switched to the heating operation state (the state shown by the broken line of the switching mechanism 23 in FIG. 3), and the compressor 21 and the outdoor fan 25 are activated. When the area S1 is specified as the space to be air-conditioned to perform heating operation, the indoor fans 33*a* and 33*b* are activated, and when the area S2 is specified as the space to be air-conditioned to perform heating operation, the indoor fans 33*c* and 33*d* are activated, and when bath of the areas S1 and S2 are specified as the space to be air-conditioned to perform heating operation, the indoor fans 33*a*, 33*b*, 33*c* and 33*d* are activated.

Subsequently, the high-pressure gas refrigerant in the refrigerant circuit 1*a* is sent from the outdoor unit 2 to the indoor units 3*a* and 3*b* and/or the indoor units 3*c* and 3*d* through the switching mechanism 23 and the gas refrigerant communication pipe 5, to heat the area S1 and/or the area S2.

The high-pressure gas refrigerant sent to the indoor units 3*a* and 3*b* and/or the indoor units 3*c* and 3*d*, is sent to the indoor heat exchangers 32*a* and 32*b* and/or the indoor heat exchangers 32*c* and 32*d*. Heat exchange is then carried out between the high-pressure gas refrigerant sent to the indoor heat exchangers 32*a* and 32*b* and/or the indoor heat exchangers 32*c* and 32*d*, and the room air (RA) supplied from the area S1 and/or the area S2 by the indoor fans 33*a* and 33*b* and/or the indoor fans 33*c* and 33*d*, in the indoor heat exchangers 32*a* and 32*b* and/or the indoor heat exchangers 32*c* and 32*d* that function as refrigerant radiators, so that the high-pressure gas refrigerant is cooled, condensed, and becomes a high-pressure liquid refrigerant. The high-pressure liquid refrigerant is decompressed by the indoor expansion mechanisms 31*a* and 31*b* and/or the indoor expansion mechanisms 31*c* and 31*d*. The refrigerant decompressed by the indoor expansion mechanisms 31*a* and 31*b* and/or the indoor expansion mechanisms 31*c* and 31*d* is sent from the indoor units 3*a* and 3*b* and/or the indoor units 3*c* and 3*d* to the outdoor unit 2 through the liquid refrigerant communication pipe 4. In contrast, the room air (RA) which has been heated in the indoor heat exchangers 32*a* and 32*b* and/or the indoor heat exchangers 32*c* and 32*d*, is sent to the area S1 and/or the area S2, to perform heating operation to the area S1 and/or the area S2.

The refrigerant sent to the outdoor unit 2 is sent to the outdoor heat exchanger 24. Heat exchange is then carried out between the refrigerant sent to the outdoor heat exchanger 24 and the outdoor air (OA) supplied by the outdoor fan 25, in the outdoor heat exchanger 24 that functions as a refrigerant evaporator, and the refrigerant is heated, evaporated, and becomes a low-pressure gas refrigerant. The low-pressure gas refrigerant is again sucked into the compressor 21 through the switching mechanism 23.

—Ventilation Operation—

A ventilation operation for ventilating the area S1 is described first. When the ventilation controller 160*a* gives a command to the ventilator 6*a* to perform the ventilation operation, the air supply fan 65*a* and the air exhaust fan 67*a* are activated. Here, the command to perform the ventilation operation is given in response to an input from the ventilation operation unit 164*a* of the ventilation controller 160*a* or in response to a request from the air conditioning controller 12.

Heat exchange is then carried out in the heat exchanger 62*a*, between the outdoor air (OA) flowing into the device main body 61*a* from the outside through the inlet duct 7, and the room air (RA) flowing into the device main body 61*a* from the area S1 through the outlet duct 9*a*. The outdoor air (OA) which has undergone the heat exchange in the heat exchanger 62*a* is supplied as a supply air (SA) from the device main body 61*a* to the area S1 through the air supply duct 8*a*, and the room air (RA) which has undergone the heat exchange in the heat exchanger 62*a* is exhausted as an exhaust air (EA) from the device main body 61*a* through the exhaust duct 10 to the outside.

A ventilation operation of performing ventilation of the area S2 is described next. When the ventilation controller 160*b* gives a command to the ventilator 6*b* to perform the ventilation operation, the air supply fan 65*b* and the air exhaust fan 67*b* are activated. Here, the command to perform the ventilation operation is given in response to an input from the ventilation operation unit 164*b* of the ventilation controller 160*b*, or in response to a request from the air conditioning controller 12.

Heat exchange is then carried out in the heat exchanger 62*b*, between the outdoor air (OA) flowing into the device main body 61*b* from the outside through the inlet duct 7, and the room air (RA) flowing into the device main body 61*b* from the area S2 through the outlet duct 9*b*. The outdoor air (OA) which has undergone the heat exchange in the heat exchanger 62*b* is supplied as the supply air (SA) from the device main body 61*b* to the area S2 through the air supply duct 8*b*, and the room air (RA) which has undergone the heat exchange in the heat exchanger 62*b* is exhausted as the exhaust air (EA) from the device main body 61*b* to the outside through the exhaust duct 10.

—Refrigerant Discharge Operation—

In this embodiment, a refrigerant discharge operation can be performed in order to prevent oxygen deficiency accidents, fire accidents (when the refrigerant is mildly flammable or combustible) or intoxication accidents (when the refrigerant is toxic) caused by refrigerant leak from the air conditioner 1 in the areas S1 and S2. In other words, when the refrigerant leaks from the air conditioner 1, and the refrigerant leak detector 11*a* and/or the refrigerant leak detector 11*b* detects the leak, it is determined that the refrigerant leaks from the indoor units 3*a* and/or 3*b* responsible for performing air conditioning of the area S1 where the leak is detected and/or from the indoor units 3*c* and/or 3*d* responsible for performing air conditioning of the area S2 where the leak is detected, and then the ventilator 6*a* of the area S1 and/or the ventilator 6*b* of the area S2 where the refrigerant is detected are forced to operate to discharge the refrigerant from the area S1 where the refrigerant is detected and/or from the area S2 where the leak is detected.

A case where the refrigerant leak detector 11*a* of the area S1 detects refrigerant is described first. When the refrigerant leak detector 11*a* responsible for refrigerant detection in the area S1 detects refrigerant, the air conditioning controller 12 (in this embodiment, the centralized controller 100) receives a signal showing the detection via the indoor controllers 130*a* and 130*b*, and gives a command to perform a refrigerant discharge operation to the indoor controllers 130*a* and 130*b* of the indoor units 3*a* and 3*b* that are responsible for performing air conditioning of the area S1, and the ventilation controller 160*a* of the ventilator 6*a* that is responsible for performing ventilation of the area S1. In this embodiment, the command to perform the refrigerant discharge operation is given to the ventilation controller 160*a* via the indoor controllers 130*a* and 130*b*.

Subsequently, the indoor controllers 130*a* and 130*b* close the indoor expansion mechanisms 31*a* and 31*b*, and gives a command to the outdoor controller 120 of the outdoor unit 2 to stop the air conditioning operation (cooling operation or heating operation). The outdoor controller 120 stops the compressor 21 and the outdoor fan 25, thereby stopping the air conditioner 1. When ventilation operation is not being performed, the ventilation controller 160*a* starts the ventilation operation by activating the air supply fan 65*a* and the air exhaust fan 67*a*, and when ventilation operation is being performed, the ventilation controller 160*a* discharges the refrigerant from the area S1 by continuing the ventilation operation.

Next, a case where the refrigerant leak detector 11*b* of the area S2 detects refrigerant is described. When the refrigerant leak detector 11*b* responsible for refrigerant detection in the area S2 detects the refrigerant, the air conditioning controller 12 (the centralized controller 100 in this embodiment) receives a signal showing the detection via the indoor controllers 130*c* and 130*d*, and gives a command to perform the refrigerant discharge operation to the indoor controllers 130*c* and 130*d* of the indoor units 3*c* and 3*d* that are responsible for the air conditioning of the area S2 and the ventilation controller 160*b* of the ventilator 6*b* that is responsible for performing ventilation of the area S2. In this embodiment, the command to perform the refrigerant discharge operation is given to the ventilation controller 160*b* the indoor controllers 130*c* and 130*d*.

Subsequently, the indoor controllers 130*c* and 130*d* close the indoor expansion mechanisms 31*c* and 31*d*, and gives a command to the outdoor controller 120 of the outdoor unit 2 to stop the air conditioning operation (cooling operation or heating operation). The outdoor controller 120 stops the compressor 21 and the outdoor fan 25, thereby stopping the air conditioner 1. When the ventilation operation is not being performed, the ventilation controller 160*b* starts the ventilation operation by activating the air supply fan 65*b* and the air exhaust fan 67*b*, and when the ventilation operation is being performed, the ventilation controller 160*b* discharges the refrigerant from the area S2 by continuing the ventilation operation. Here, the command to perform the refrigerant discharge operation is given to the ventilation controller 160*b* via the indoor controllers 130*c* and 130*d*.

(3) Connection of Communication System Between Air Conditioner and Ventilator After Installed at a Site The operation in conjunction with the multi-type, room air conditioner 1 and the ventilators 6*a* and 6*b*, such as the refrigerant discharge operation, is achieved by connecting a communication system between the air conditioner 1 and the ventilators 6*a* and 6*b*. In other words, when no communication system is connected between the air conditioner 1 and the ventilators 6*a* and 6*b*, the air conditioner 1 and the ventilators 6*a* and 6*b* are not operated in conjunction with each other to operate but simply operate independently (that is, the air conditioning operation and the ventilation operation are simply operated independently). Thus, in consideration of the case where the multi-type room air conditioner 1 and the ventilators 6*a* and 6*b* are selected and installed independently, there is a possibility that the communication system between the air conditioner 1 and the ventilators 6*a*, 6*b* is not securely connected at an installation site, even when a configuration of performing the refrigerant discharge operation as described above is to be employed. Therefore, the following problem is involved in the configuration where the multi-type room air conditioner 1 and the ventilators 6*a* and 6*b* are installed independently of each other: the air conditioner 1 can be operated without any countermeasures such as operating the ventilators 6*a* and 6*b* when refrigerant leaks, and thereby it is impossible to suppress an accident caused by the refrigerant leak from the air conditioner 1.

Therefore, in this embodiment, as described below, the air conditioning controller 12 is configured to perform an area registration process to allocate the indoor units 3*a*, 3*b*, 3*c*, 3*d* individually to one of the area identification frames (in this embodiment, G1, G2) corresponding to the areas (in this embodiment, the areas S1, S2) of the space to be air-conditioned, and allocate the ventilators 6*a* and 6*b* that perform ventilation of the space to be air-conditioned, individually to one of the area identification frames G1 and G2 where the indoor units 3*a*, 3*b*, 3*c*, and 3*d* are allocated. In addition, the air conditioning controller 1 is configured such that, when none of the ventilators 6*a* and 6*b* is allocated to the area identification frame G1 or G2 where the indoor units 3*a*, 3*b*, 3*c*, and/or 3*d* are allocated, the operations of the plurality of indoor units 3*a*, 3*b*, 3*c*, 3*d* are not allowed to be performed.

Figure 7:
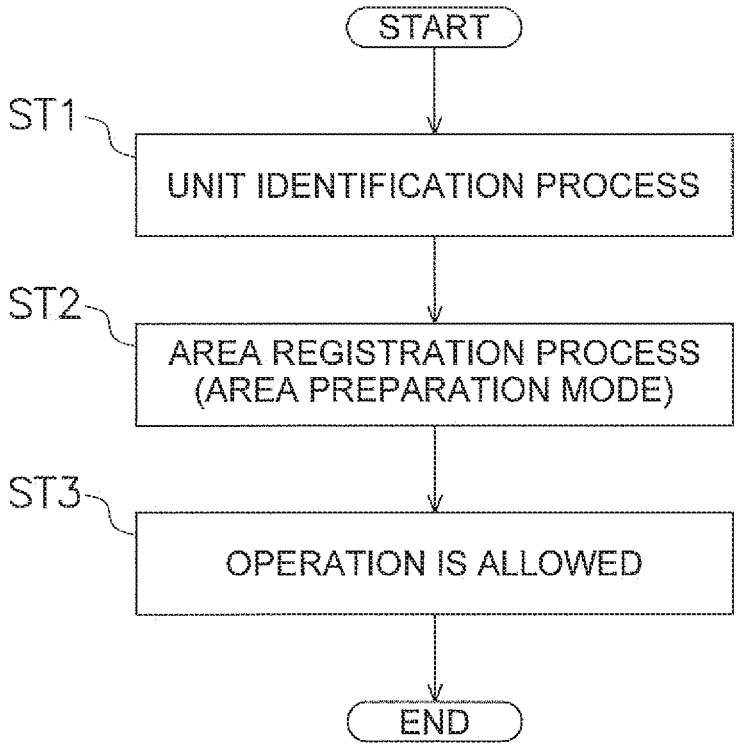
FIG. 7 is a flowchart showing a process of connecting a communication system between devices after installed at a site.
Figure 8:
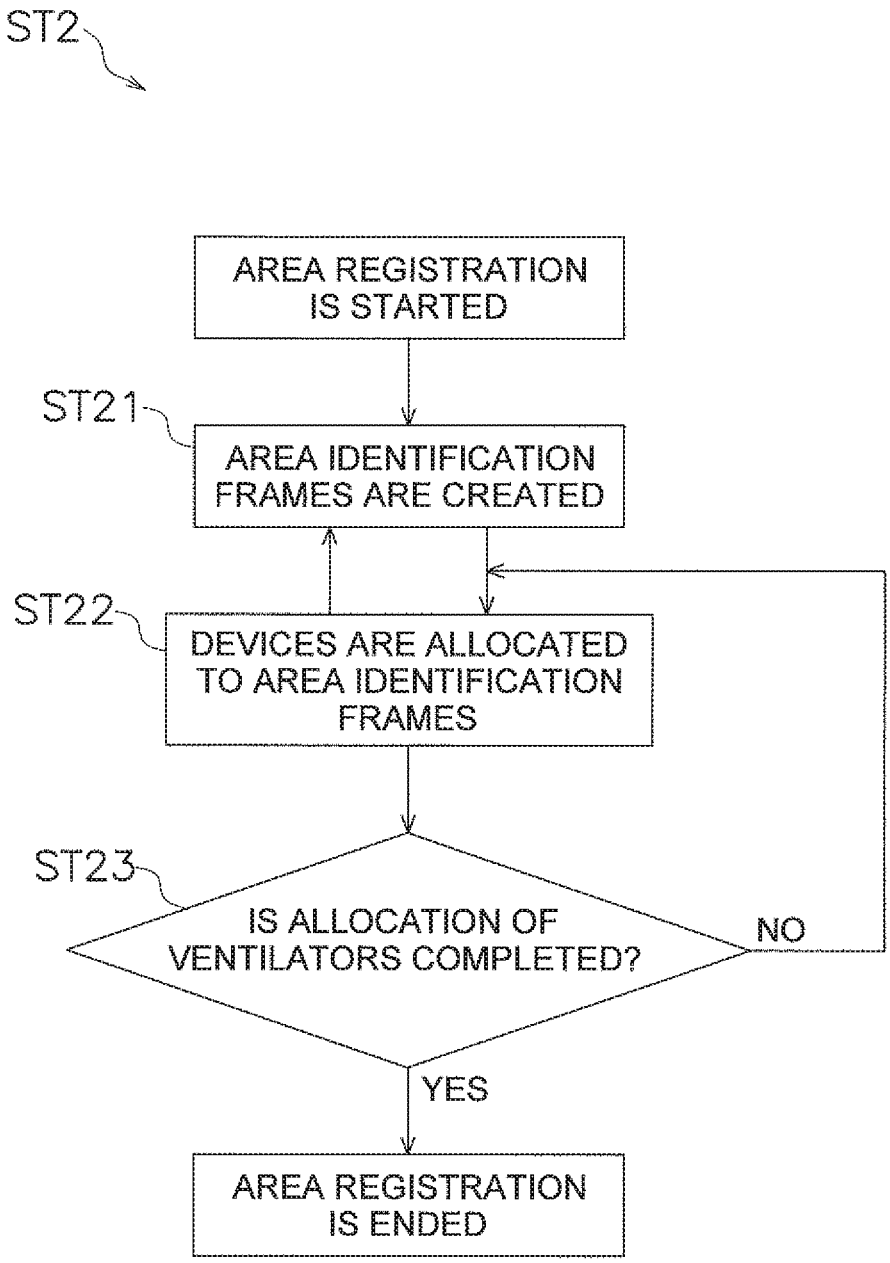
FIG. 8 is a flowchart showing an area registration process.
Figure 9:
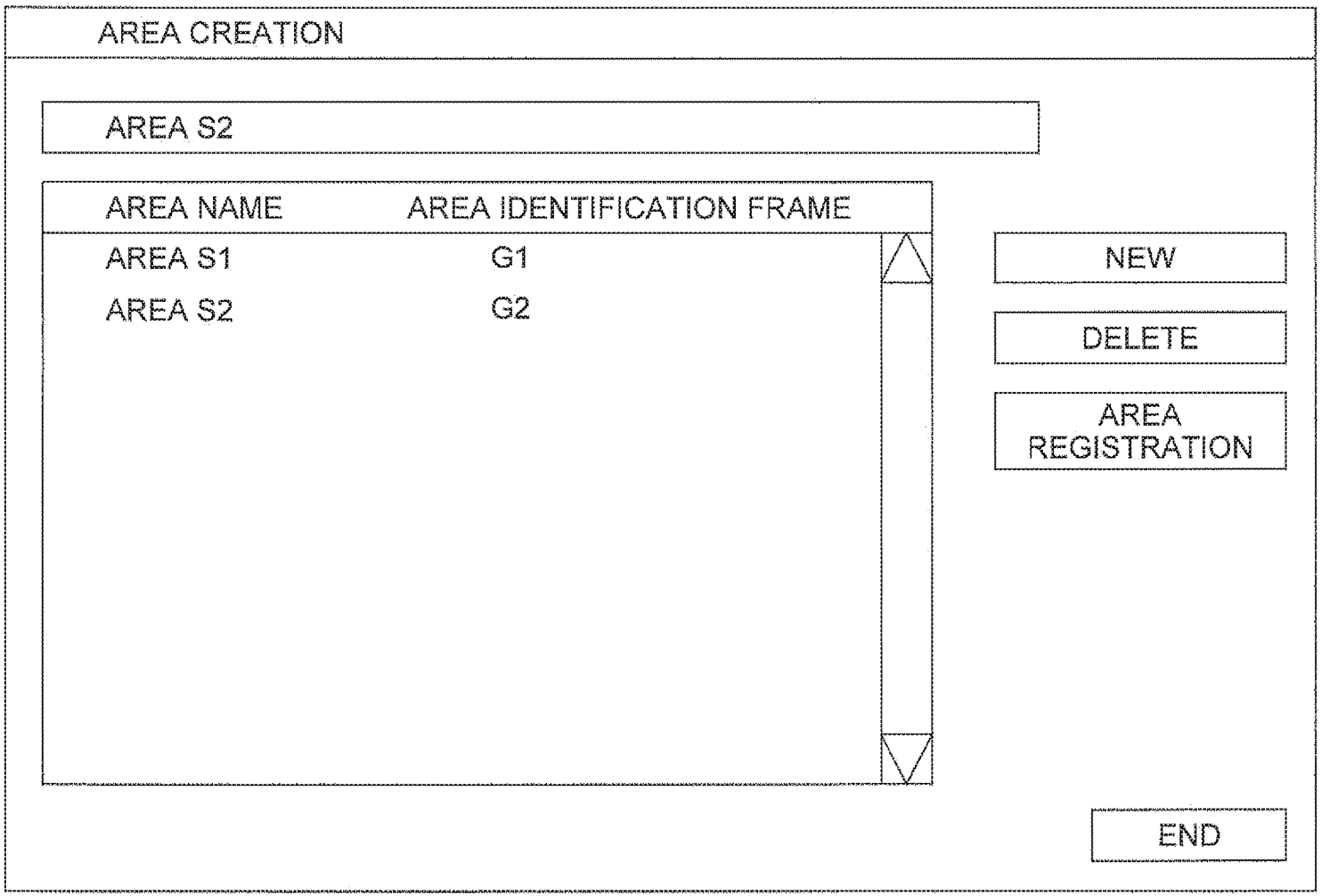
FIG. 9 shows an example of a work screen displayed while area identification frames are created.
Figure 10:
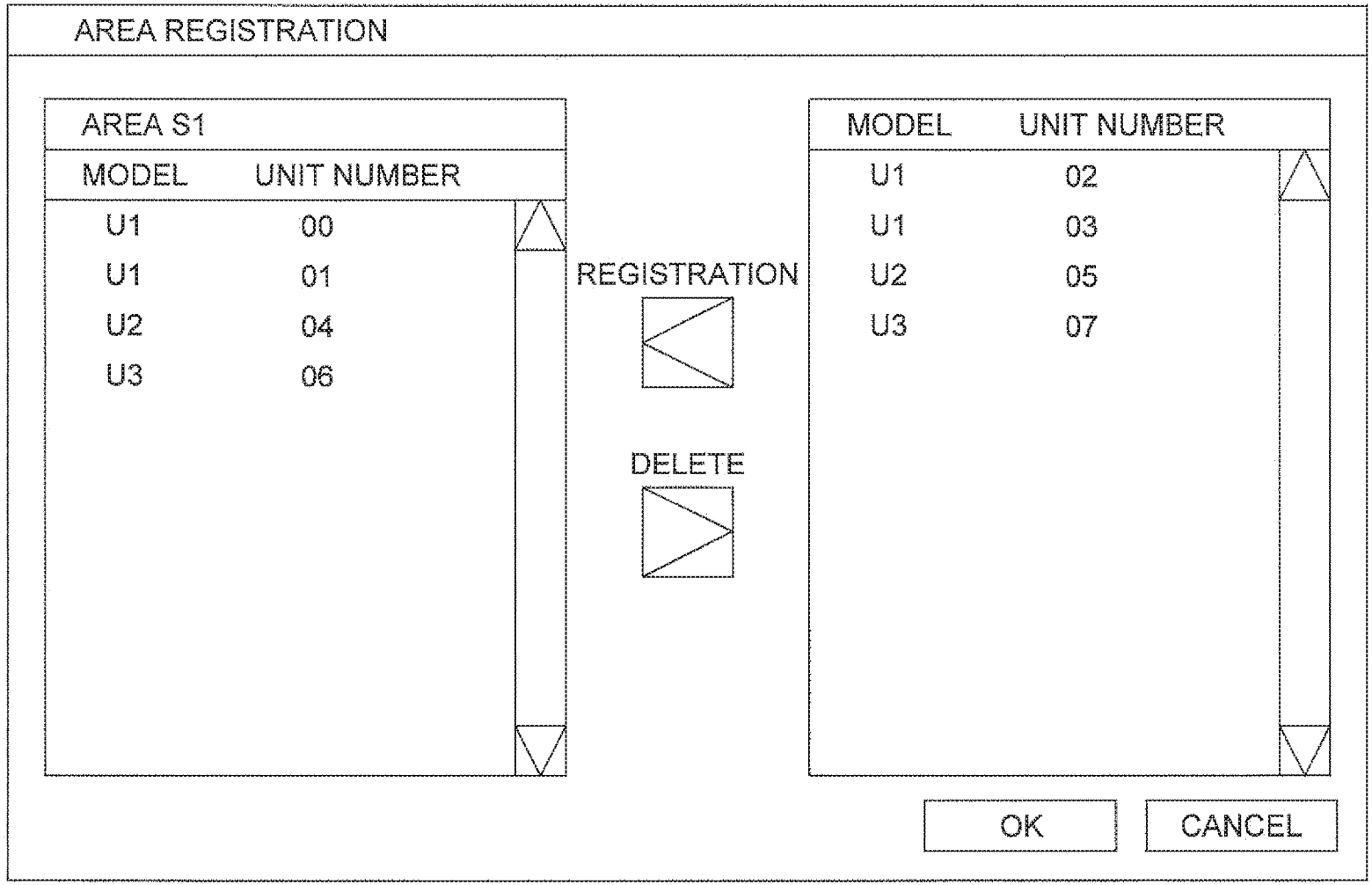
FIG. 10 shows an example of a work screen displayed while devices are allocated individually to one of the area identification frames.
Figure 11:
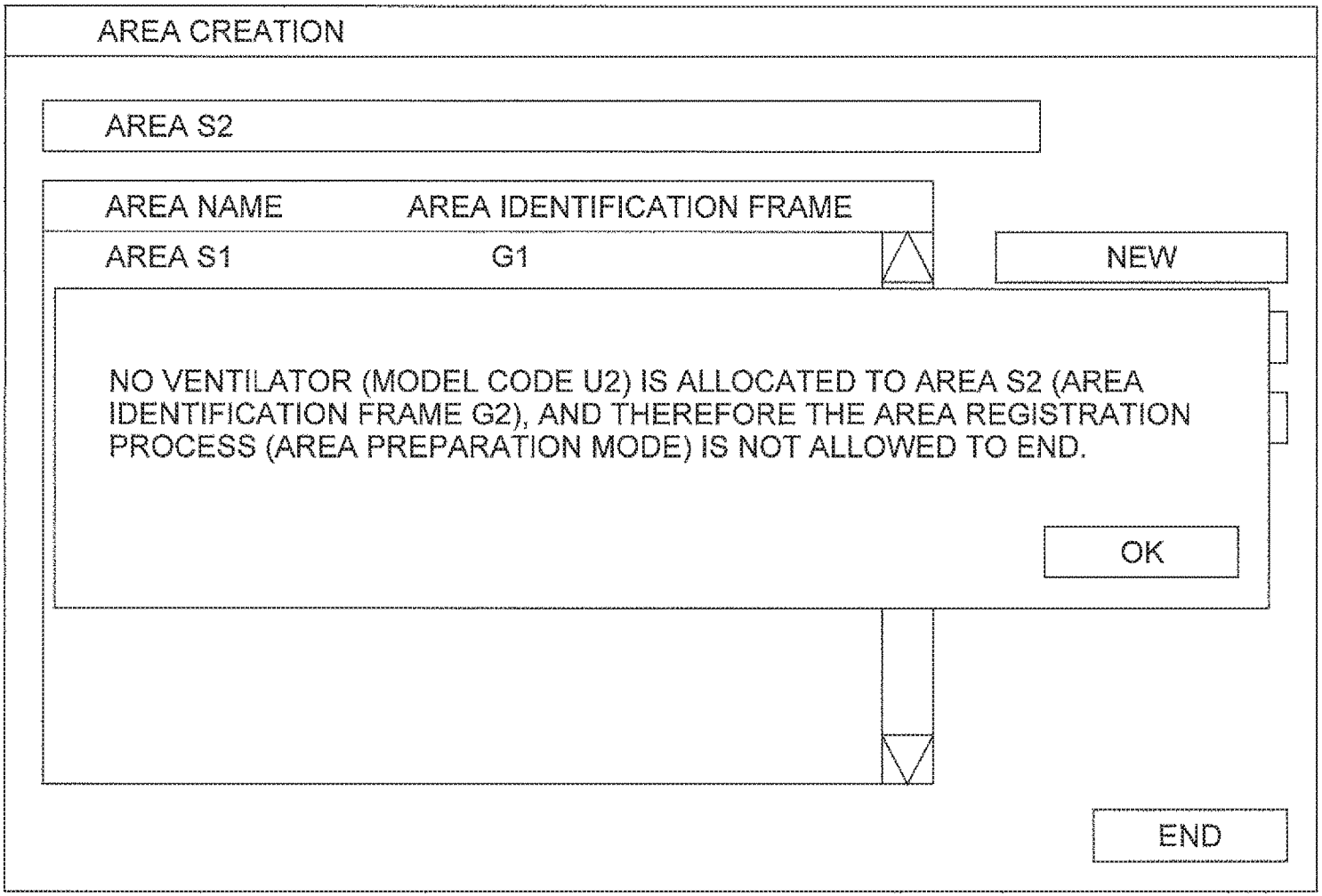
FIG. 11 shows an example of a work screen displayed while a user tries to end the area registration process with presence of an area identification frame to which none of the ventilators is allocated.
Figure 12:
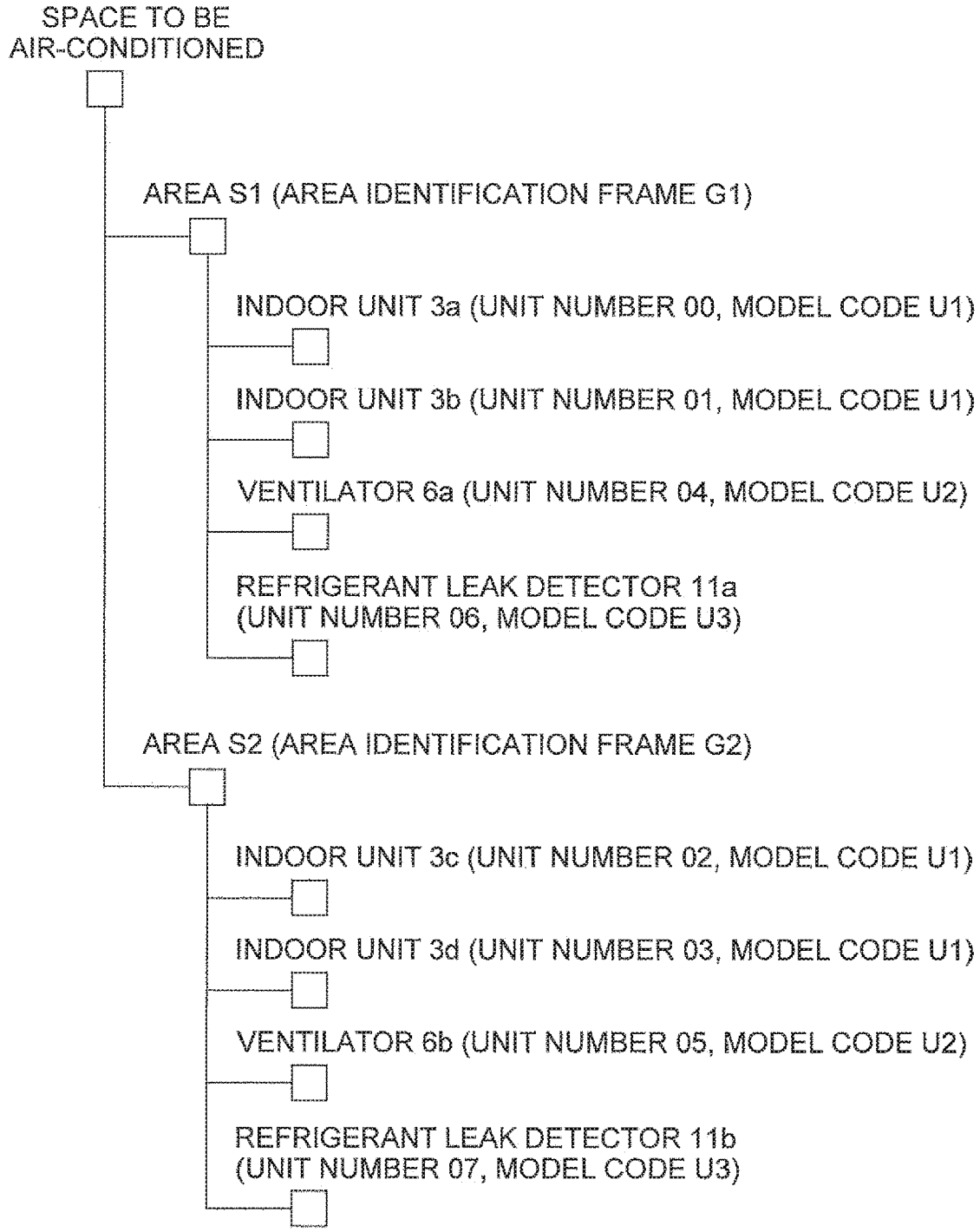
FIG. 12 is a diagram showing a correspondence between the areas and devices after the operation is allowed.

The connection of the communication system between the air conditioner 1 and the ventilators 6*a* and 6*b* is described hereafter, using FIG. 7 to FIG. 12. Here, FIG. 7 is a flowchart showing a process of connecting the communication system between the devices 1, 11*a*, 11*b*, 6*a*, and 6*b* after installed at a site. FIG. 8 is a flowchart showing an area registration process. FIG. 9 shows an example of a work screen displayed while the area identification frames are created. FIG. 10 shows an example of a work screen displayed while devices are allocated individually to one of area identification frames. FIG. 11 shows an example of a work screen displayed while a user tries to end the area registration process with presence of an area identification frame to which none of the ventilators is allocated. FIG. 12 is a diagram showing a correspondence between the areas and devices after the operation is allowed.

—Unit Identification Process—

First, in step ST1, the air conditioning controller 12 performs a unit identification process of assigning unit numbers respectively to the indoor units 3*a*, 3*b*, 3*c*, 3*d*, the ventilators 6*a*, 6*b*, and the refrigerant leak detectors 11*a*, 11*b* to distinguish them from each other. In this embodiment, the unit numbers "00" to "07" are assigned to the indoor units 3*a*, 3*b*, 3*c*, 3*d*, the ventilators 6*a*, 6*b*, and the refrigerant leak detectors 11*a*, 11*b* respectively. In this embodiment, the unit identification process is mainly performed by the unit identifier 107 and the like of the centralized controller 100. Then, the assigned unit numbers are all stored in the centralized storage unit 103 of the centralized controller 100, together with the model codes showing the types of the device (in this embodiment, "U1" indicating the indoor units 3*a*, 3*b*, 3*c* and 3*d* of the air conditioner 1, "U2" indicating the ventilators 6*a* and 6*b*, and "U3" indicating the refrigerant leak detectors 11*a* and 11*b*). Furthermore, the corresponding unit numbers are stored in the storage units 133*a*, 133*b*, 133*c*, 133*d*, 163*a*, 163*b*, 113*a* and 113*b* of the controllers 130*a*, 130*b*, 130*c*, 130*d*, 160*a*, 160*b*, 110*a*, and 110*b* of the devices 3*a*, 3*b*, 3*c*, 3*d*, 6*a*, 6*b*, 11*a*, and 11*b*.

—Area Registration Process—

Next, in step ST2, the air conditioning controller 12 performs an area registration process to allocate the indoor units 3*a*, 3*b*, 3*c*, and 3*d* individually to one of the area identification frames (in this embodiment, G1 and G2) each corresponding to the predetermined areas (in this embodiment, areas S1 and S2) of the space to be air-conditioned, and allocate the ventilators 6*a* and 6*b* that perform ventilation of the space to be air-conditioned, respectively to the area identification frames G1 and G2 where the indoor units 3*a*, 3*b*, 3*c*, and 3*d* are allocated. Furthermore, in the area registration process of this embodiment, not only the ventilators 6*a* and 6*b*, but also the refrigerant leak detectors 11*a* and 11*b* that detect the leak of refrigerant are individually allocated to one of the area identification frames G1 and G2. In this embodiment, the indoor units 3*a* and 3*b*, the ventilator 6*a*, and the refrigerant leak detector 11*a* are allocated to the area identification frame "G1" corresponding to the area S1, and the indoor units 3*c* and 3*d*, the ventilator 6*b*, and the refrigerant leak detector 11*b* are allocated to the area identification frame "G2" corresponding to the area S2. In this embodiment, the area registration process is mainly performed by the area registration unit 108 of the centralized controller 100.

Specifically, the area registration process is performed in an area preparation mode which is started after the unit identification process in step ST1 is completed.

When the area preparation mode is started, first, in step ST21, the area identification frames each corresponding to predetermined areas of the space to be air-conditioned are created. Here, the area identification frames are created by input via the centralized operation unit 104, with reference to a work screen which is displayed on the centralized display unit 105 while the area identification frames are created. According to FIG. 9, pressing a "New" button on the work screen makes it possible to input area names (in this embodiment, the areas S1 and S2) at the top of the work screen, and upon the input of the area names here, the area identification frames (in this embodiment, G1 and G2) are given and displayed, so that the area identification frames can be listed together with the area names at the center of the work screen.

Next, in step ST22, devices are allocated individually to one of the area identification frames. Here, the devices are allocated to the area identification frames by input via the centralized operation unit 104, with reference to the work screen which is selected and displayed on the centralized display unit 105 while devices are allocated to the area identification frames. According to FIG. 10, when the devices are selected from the list of non-allocated devices on the right side of the work screen and the "Register" button is pressed, the devices (in this embodiment, indoor units 3*a*, 3*b*, ventilator 6*a*, refrigerant leak detector 11*a* each corresponding to unit numbers 00, 01, 04, 06) are allocated to the area identification frame (here, G1 corresponding to the area S1) that has been selected and displayed on the work screen, and the devices are listed and displayed on the left side of the work screen. Then, when the "OK" button at the bottom right of the work screen is pressed, the allocation of the devices to the selected and displayed area identification frame ends, and the process returns to the work screen of FIG. 9. Although not shown, in a work screen similar to that of FIG. 10, devices are selected from the list of devices that have not been allocated, and then the devices (in this embodiment, the indoor units 3*c* and 3*d*, the ventilator 6*b*, the refrigerant leak detector 11*b* each corresponding to the unit numbers 02, 03, 05, 07) are allocated to the area identification frame G2 corresponding to the area S2. Switching from the work screen of FIG. 9 to the work screen of FIG. 10 is performed by pressing the "Area Registration"

button in the work screen (FIG. 9) for creating the area identification frames displayed on the centralized display unit 105, in a state where the area name (for example, the area S1) to which devices are to be allocated is selected.

Next, in step ST23, it is determined whether or not a ventilator is allocated to each of a plurality of area identification frames where the indoor units are allocated. Furthermore, here, it is also determined whether not only the ventilator but also a refrigerant leak detector is allocated thereto. In this embodiment, the determinations are made when the "End" button on the work screen is pressed in the work screen (FIG. 9) for creating the area identification frames that is displayed on the centralized display unit 105.

Subsequently, in step ST22, when the ventilator 6*a* and the refrigerant leak detector 11*a* are allocated to the area identification frame "G1" corresponding to the area S1 where the indoor units 3*a* and 3*b* are allocated, and also the ventilator 6*b* and the refrigerant leak detector 11*b* are allocated to the area identification frame "G2" corresponding to the area S2 where the indoor units 3*c* and 3*d* are allocated, it is determined that all of the plurality of area identification frames where the indoor units are allocated each have a ventilator allocated thereto, and the area registration process, that is the area preparation mode, ends. At this point of time, the correspondence between each device and the area identification frame obtained by the area registration unit 108 is stored in the centralized storage unit 103 as data associated with the unit number and the model code (see FIG. 12). The area identification frames allocated by the area registration unit 108 are stored in the storage units 133*a*, 133*b*, 133*c*, 133*d*, 163*a*, 163*b*, 113*a*, and 113*b* of the controllers 130*a*, 130*b*, 130*c*, 130*d*, 160*a*, 160*b*, 110*a*, and 110*b* of each of the devices 3*a*, 3*b*, 3*c*, 3*d*, 6*a*, 6*b*, 11*a*, and 11*b*. Furthermore, the unit numbers and the model codes of the ventilators 6*a*, 6*b* and the refrigerant leak detectors 11*a*, 11*b* allocated to the same area identification frames respectively are also stored in the indoor storage units 133*a*, 133*b*, 133*c*, and 133*d*. Thereafter, in step ST3, the operations of the air conditioner 1 having the plurality of indoor units 3*a*, 3*b*, 3*c*, and 3*d* are allowed, and the process of connecting, the communication system between the air conditioner 1, and the ventilators 6*a*, 6*b*, and the refrigerant leak detectors 11*a* and 11*b* ends.

In contrast, in step ST22, when the ventilator 6*a* and the refrigerant leak detector 11*a* are not allocated to area identification frame "G1" corresponding to the area S1 where the indoor units 3*a* and 3*b* are allocated, or the ventilator 6*b* and the refrigerant leak detector 11*b* are not allocated to the area identification frame "G2" corresponding to the area. S2 to which the indoor units 3*c* and 3*d* are allocated, it is determined that there is an area identification frame to which none of the ventilators is allocated in the plurality of area identification frames where the indoor units are allocated, and the area registration process, that is the area preparation mode, is not allowed to end. For example, when the ventilator 6*b* is not allocated to the area S2 (the area identification frame G2), as shown in FIG. 11, an error message indicating the fact can be displayed at the time of pressing the "End" button in the work screen for creating the area identification frames that are displayed on the centralized display unit 105, so that the area registration process, that is the area preparation mode, is not allowed to end. Thus, as long as there is an area identification frame to which none of the ventilators is allocated in the plurality of area identification frames where the indoor units are allocated, the operation is not allowed in the step ST3, and the air conditioner 1 having the plurality of indoor units 3*a*, 3*b*, 3*c*, and 3*d* cannot be operated.

As described above, in the area registration process to allocate the plurality of the indoor units 3*a*, 3*b*, 3*c*, and 3*d* constituting the multi-type room air conditioner 1 individually to one of the predetermined areas S1 and S2 of the space to be air-conditioned, the process is performed to allocate the indoor units 3*a*, 3*b*, 3*c*, and 3*d* individually to one of the area identification frames G1 and G2 corresponding to the areas S1 and S2 respectively, and also the process is performed to allocate the ventilators 6*a* and 6*b* individually to one of the area identification frames G1 and G2 to which the indoor units 3*a*, 3*b*, 3*c*, and 3*d* are allocated. Therefore, in this embodiment, it is possible to establish a state in which there is no area identification frame, in the area identification frames G1 or G2, that has none of the ventilators 6*a* and 6*b* allocated thereto, and the communication system between the air conditioner 1 and the ventilators 6*a* and 6*b* is securely connected at the installation site.

Thus, in this embodiment, even in a configuration in which the multi-type room air conditioner 1 and the ventilators 6*a* and 6*b* are independently installed, the air conditioner 1 can be operated in a state with an established countermeasure such as operating the ventilators 6*a* and 6*b* when refrigerant leaks, which can be surely suppressed the occurrence of an accident caused by refrigerant leak from the air conditioner 1.

In addition, in this embodiment, in the area preparation mode, when there is an area identification frame without either of the ventilators 6*a* and 6*b* allocated thereto, in the plurality of area identification frames G1 and G2 where the indoor units 3*a*, 3*b*, 3*c*, and 3*d* are allocated, the area preparation mode is not allowed to end. Therefore, in this embodiment, the area registration process is surely performed before the air conditioning operation is started, so that the state with a countermeasure such as operating the ventilators 6*a* and 6*b* when refrigerant leaks is able to be surely established.

Furthermore, in this embodiment, the centralized controller 100 in the air conditioning controller 12 is configured to perform the area registration process. Therefore, the control command is given to each of the area identification frames G1 and G2, that is, the communication system between the air conditioner 1 and the ventilators 6*a* and 6*b* is able to be securely connected at the installation site via the centralized controller 100 that performs area controlling.

(4) Modified Examples

<A>

In the abovementioned embodiment, a ceiling installation type is employed for the indoor units 3*a*, 3*b*. 3*c*, and 3*d* However, the present invention is not limited thereto, and for example, indoor units of other types for wall installation, wall-back installation, floor installation, under-floor installation, ceiling-back installation, and machine room installation may be used.

<B>

In the abovementioned embodiment, a ceiling-back installation type is employed for the ventilators 6*a* and 6*b*. However, the present invention is not limited thereto, and for example, ventilators of other types for wall-back installation, under-floor installation, and machine room installation may be used. Furthermore, in the abovementioned embodiment, a type with the total heat exchangers 62*a* and 62*b* is employed for the ventilators 6*a* and 6*b*. However, the present invention is not limited thereto, and for example, other types of the ventilators such as those having only a fan may be used.

<C>

In the abovementioned embodiment, a wired communication connection in which controllers are connected to each other via a communication line is employed. However, the present invention is not limited thereto, and other types of communication connection such as a wireless communication may be used.

<D>

In the abovementioned embodiment, the refrigerant leak detectors 11*a* and 11*b* are connected to the indoor units 3*a*, 3*b*, 3*c* and 3*d* (specifically, the indoor controllers 130*b* and 130*d*). However, the present invention is not limited thereto, and the refrigerant leak detectors 11*a* and 11*b* may be connected to the ventilators 6*a* and 6*b* (specifically ventilation controllers 160*a* and 160*b*).

<E>

In the abovementioned embodiment, the refrigerant leak detectors 11*a* and 11*b* are located in the areas S1 and S2 of the space to be air-conditioned. However, the present invention is not limited thereto, and for example, the refrigerant leak detectors 11*a* and 11*b* may be provided to the indoor units 3*a*, 3*b*, 3*c*, and 3*d* and/or the ventilators 6*a* and 6*b*.

<F>

In the abovementioned embodiment, the centralized controller 100 determines whether or not the refrigerant discharge operation is required. However, the present invention is not limited thereto, and the indoor controllers 130*a*, 130*b*, 130*c*, and 130*d* may make the determination.

<G>

In the abovementioned embodiment, the centralized controller 100 is located in the area S2 of the space to be air-conditioned. However, the centralized controller 100 may be located in another space within a construction to be air-conditioned, or may be located at a remote place such as outside of the construction to be air-conditioned.

<H>

In the abovementioned embodiment, the centralized controller 100 is provided to control the air conditioner 1 for each of the areas S1 and S2 (in each of the area identification frames G1 and G2). However, when a remote controller is provided corresponding to each of the indoor units 3*a*, 3*b*, 3*c*, and 3*d*, one of these remote controllers may function as the centralized controller 100.

<I>

Figure 13:
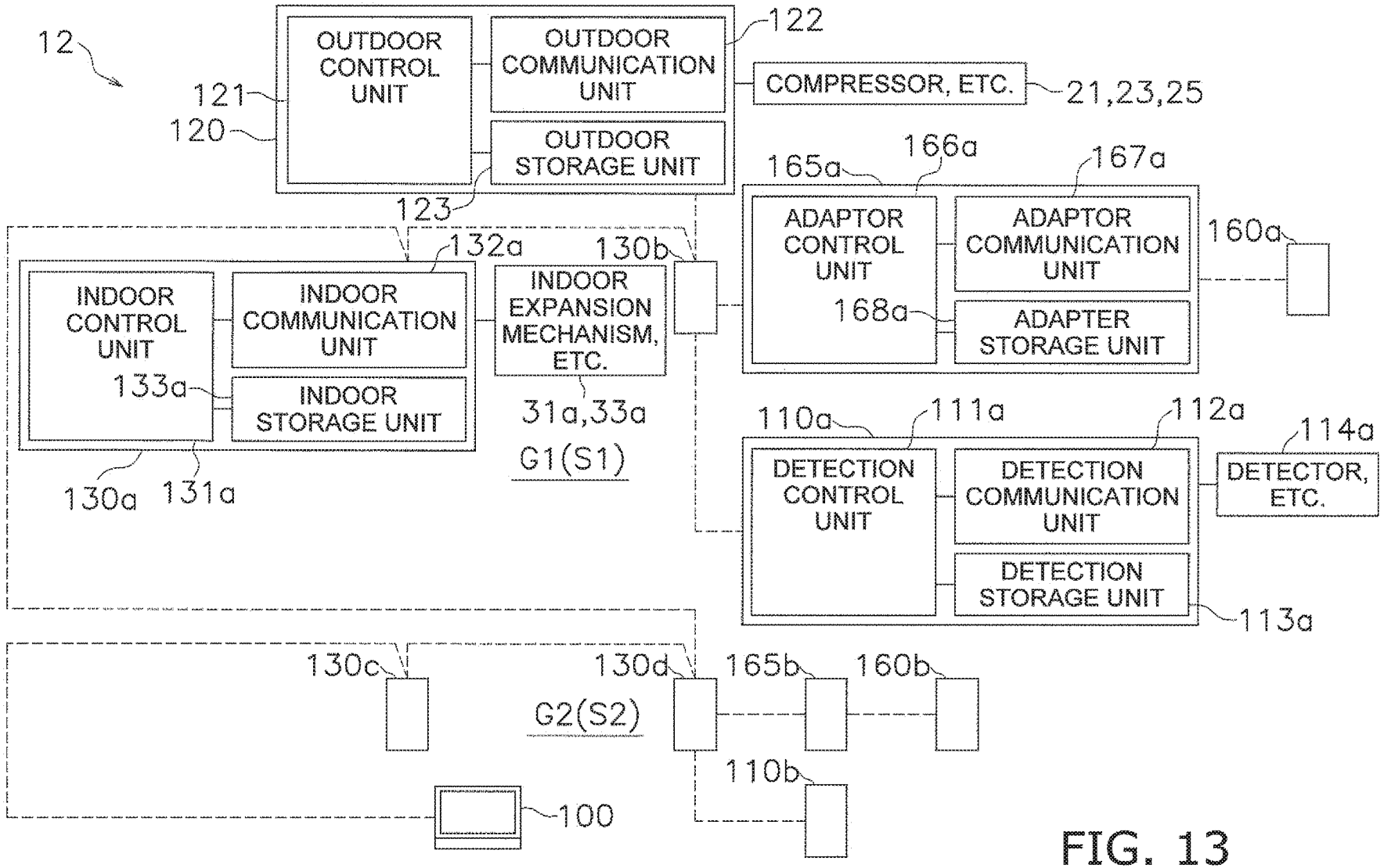
FIG. 13 is a control block diagram of an air-conditioning ventilation system in a case where a communication connection is established between indoor units and ventilators via adaptor devices.

In the abovementioned embodiment, the communication between the air conditioner 1 (specifically, the indoor units 3*a*, 3*b*, 3*c*, and 3*d*) and the ventilators 6*a* and 6*b*, is performed by direct connection between the indoor controllers 130*a*, 130*b*, 130*c*, and 130*d* and the ventilation controllers 160*a* and 160*b*. However, the present invention is not limited thereto. For example, when the communication cannot be established by directly connecting the indoor controllers 130*a*, 130*b*, 130*c*, 130*d* and the ventilation controllers 160*a*, 160*b*, as shown in FIG. 13, adapter devices 165*a* and 165*b* may be connected to the ventilation controllers 160*a* and 160*b* respectively so that the communication between the indoor units 3*a*, 3*b*, 3*c*, and 3*d* and the ventilators 6*a* and 6*b* can be established. In this case, adapter communication units 167*a* and 167*b* of the adapter devices 165*a* and 165*b* respectively perform communication with the centralized controller 100 and the indoor controllers 130*a*, 130*b*, 130*c*, and 130*d*, and adapter storage units 168*a* and 168*b* store the unit numbers and the values of the area identification frames, and adapter controllers 166*a* and 166*b* give operation commands and the like to the ventilation controllers 160*a* and 160*b*. In FIG. 13, none of the devices 166*b*, 167*b*, 168*b* of the adapter device 165*b* are shown.

<J>

In the abovementioned embodiment, numbers and symbols such as "00", "G1", "U1" are respectively used as values of the unit number, the area identification frame and the model code. However, the present invention is not limited thereto, and for example a character string indicating a specific name may also be used.

<K>

In the abovementioned embodiment, the area registration process is performed on the work screens as shown in FIG. 9 to FIG. 11. However, the present invention is not limited thereto.

Furthermore, in the abovementioned embodiment, a work of allocating devices individually to one of area identification frames is performed for the indoor units 3*a*, 3*b*, 3*c*, and 3*d* together with the ventilators 6*a* and 6*b*. However, the present invention is not limited thereto. For example, the work of allocating devices may be performed separately for each type of the devices in accordance with a guidance: for example, the ventilators 6*a* and 6*b* are allocated after individual allocation of the indoor units 3*a*, 3*b*, 3*c*, and 3*d* to one of the area identification frames.

INDUSTRIAL APPLICABILITY

The present invention is widely applicable to the air conditioner including: a plurality of indoor units configured to constitute a refrigerant circuit through which a refrigerant circulates and to perform air conditioning of a space to be air-conditioned; and an air conditioning controller configured to perform operation control of the plurality of indoor units by allocating the plurality of indoor units individually to one of predetermined areas of the space to be air-conditioned.

What is claimed is:

1. An air conditioner configured to be part of an air-conditioning ventilation system that includes the air conditioner, a plurality of ventilators configured to perform ventilation of a space to be air-conditioned, and a plurality of refrigerant leak detectors configured to detect whether refrigerant has leaked from the air conditioner, the air conditioner comprising:

a plurality of indoor units forming parts of a refrigerant circuit through which a refrigerant circulates and being configured to perform air conditioning of the space to be air-conditioned; and an air conditioning controller configured to control operations of the plurality of indoor units by allocating the plurality of indoor units individually to a plurality of predetermined areas of the space to be air-conditioned, the air conditioning controller being configured to perform an area registration process of allocating at least one of the indoor units individually to each area identification frame among a plurality of area identification frames corresponding to the predetermined areas, allocating at least one of the ventilators individually to each of the area identification frames, respectively, where the indoor units are allocated, and allocating at least one of the refrigerant leak detectors individually to each of the area identification frames, respectively, where the indoor units are allocated, the air conditioning controller being configured not to allow the operations of the plurality of the indoor units when there is an area identification frame to which none of the ventilators is allocated, in the plurality of area identification frames where the indoor units are allocated, and the air conditioning controller being configured such that when one of the refrigerant leak detectors detects that refrigerant has leaked from the air conditioner, the air conditioning controller forces operation of the ventilator allocated to the same area identification frame as the one of the refrigerant leak detectors such that the leaked refrigerant is discharged from the predetermined area corresponding to the same area identification frame.

2. The air conditioner according to claim 1, wherein the air conditioning controller includes a plurality of indoor controllers configured to control components of the indoor units, and a centralized controller configured to give a control command to the plurality of indoor controllers for each of the area identification frames where the indoor units are allocated so as to control, the centralized controller being configured to perform the area registration process.

3. The air conditioner according to claim 2, wherein the centralized controller is configured to store the area identification frames obtained by the area registration process and correspondences between indoor units and ventilators.

4. The air conditioner according to claim 3, wherein the centralized controller is configured such that, when none of the ventilators is allocated to one of the area identification frames where the indoor units are allocated, the area registration process is not allowed to be performed.

5. The air conditioner according to claim 4, wherein the centralized controller is configured to receive control commands and to allocate the indoor units and the ventilators based on the control commands during the area registration process.

6. The air conditioner according to claim 5, wherein the centralized controller includes a display, and the centralized controller is configured to display a work screen on the display for allocating the indoor units and the ventilators among the area identification frames and to allocate the indoor units and the ventilators in response to user input during the area registration process.

7. The air conditioner according to claim 3, wherein the indoor controller stores the area identification frame allocated during the area registration process and the at least one of the ventilators allocated to the same area identification frame.

* * * * *